US011512483B2

(12) United States Patent
Richardson et al.

(10) Patent No.: US 11,512,483 B2
(45) Date of Patent: Nov. 29, 2022

(54) SNAP-TOGETHER STANDOFFS FOR RESTORING, REPAIRING, REINFORCING, PROTECTING, INSULATING AND/OR CLADDING STRUCTURES

(71) Applicant: CFS Concrete Forming Systems Inc., Vancouver (CA)

(72) Inventors: George David Richardson, Vancouver (CA); Semion Krivulin, Richmond (CA)

(73) Assignee: CFS Concrete Forming Systems Inc., Vancouver (CA)

( * ) Notice: Subject to any disclaimer, the term of this patent is extended or adjusted under 35 U.S.C. 154(b) by 329 days.

(21) Appl. No.: 16/894,634

(22) Filed: Jun. 5, 2020

(65) Prior Publication Data

US 2020/0370316 A1 Nov. 26, 2020

Related U.S. Application Data

(63) Continuation of application No. PCT/CA2018/051666, filed on Dec. 21, 2018.
(Continued)

(51) Int. Cl.
*E04G 23/02* (2006.01)
*E04F 13/08* (2006.01)
(Continued)

(52) U.S. Cl.
CPC ..... *E04G 23/02* (2013.01); *E04F 13/083* (2013.01); *E04F 13/0807* (2013.01);
(Continued)

(58) Field of Classification Search
CPC . E04F 13/0891; E04F 13/0807; E04F 13/083; E04F 13/18; E04F 13/21; E04G 23/02; E04G 23/0214
See application file for complete search history.

(56) References Cited

U.S. PATENT DOCUMENTS 154,179 A 8/1874 Hubert
374,826 A 12/1887 Clarke
(Continued)

FOREIGN PATENT DOCUMENTS

CA 0574720 4/1959
CA 0957816 11/1974
(Continued)

OTHER PUBLICATIONS

Vector Corrosion Technologies Marketing Materials, 2005.
(Continued)

*Primary Examiner* — Christine T Cajilig
(74) *Attorney, Agent, or Firm* — Todd A. Rattray; Oyen Wiggs Green & Mutala LLP

(57) ABSTRACT

A method covers at least a portion of a surface of an existing structure with a repair structure. The method comprises: providing a standoff, the standoff elongated in a longitudinal direction and operable from an open configuration to a closed configuration; while the standoff is in the open configuration, mounting the standoff to the existing structure, such that the standoff projects outwardly away from the surface of the existing structure; closing the standoff to the closed configuration, the closing of the standoff forming a standoff connector; and coupling a cladding panel to the standoff by engaging the panel with the standoff connector at a location spaced outwardly apart from the surface of the existing structure by a void.

19 Claims, 23 Drawing Sheets

Related U.S. Application Data

(60) Provisional application No. 62/641,927, filed on Mar. 12, 2018, provisional application No. 62/610,145, filed on Dec. 22, 2017.

(51) Int. Cl.
*E04F 13/18* (2006.01)
*E04F 13/21* (2006.01)

(52) U.S. Cl.
CPC ..... *E04F 13/0891* (2013.01); *E04F 13/18* (2013.01); *E04F 13/21* (2013.01)

(56) References Cited

U.S. PATENT DOCUMENTS 510,720 A 12/1893 Stewart, Jr.
820,246 A 5/1906 Nidds
3,545,152 A 12/1907 Knohl
1,035,206 A 8/1912 Lewen
1,080,221 A 12/1913 Jester
1,175,168 A 3/1916 Moulton
1,244,608 A 10/1917 Hicks
1,276,147 A 8/1918 White
1,345,156 A 6/1920 Flynn
1,423,879 A 7/1922 Potter
1,540,570 A 6/1925 Roberts
1,637,410 A 8/1927 Corybell
1,653,197 A 12/1927 Barnes
1,715,466 A 6/1929 Miller
1,820,897 A 8/1931 White et al.
1,875,242 A 8/1932 Hathaway
1,915,611 A 6/1933 Miller
1,963,153 A 6/1934 Schmieder
2,008,162 A 7/1935 Waddell
2,050,258 A 8/1936 Bemis
2,059,483 A 11/1936 Parsons
2,076,472 A 4/1937 London
2,164,681 A 7/1939 Fould
2,172,052 A 9/1939 Robbins
2,314,448 A 3/1943 Hoggatt
2,326,361 A 8/1943 Jacobsen
2,354,485 A 7/1944 Slaughter
2,845,685 A 8/1958 Lovgren et al.
2,861,277 A 11/1958 Hermann
2,871,619 A 2/1959 Walters
2,892,340 A 6/1959 Fort
2,928,115 A 3/1960 Hill
3,043,407 A 7/1962 Earl
3,063,122 A 11/1962 Katz
3,100,677 A 8/1963 Frank et al.
3,128,851 A 4/1964 Deridder et al.
3,152,354 A 10/1964 Diack
3,184,013 A 5/1965 Pavlecka
3,196,990 A 7/1965 Handley
3,199,258 A 8/1965 Jentoft et al.
3,220,151 A 11/1965 Goldman
3,242,834 A 3/1966 Sondheim
3,288,427 A 11/1966 Pluckebaum
3,291,437 A 12/1966 Bowden et al.
3,301,147 A 1/1967 William et al.
3,321,884 A 5/1967 Klaue
3,385,182 A 5/1968 Harvey
3,468,088 A 9/1969 Miller
3,555,751 A 1/1971 Thorgusen
3,555,762 A 1/1971 Costanzo
3,588,027 A 6/1971 Bowden
3,682,434 A 8/1972 Boenig
3,760,544 A 9/1973 Hawes et al.
3,769,769 A 11/1973 Kohl
3,788,020 A 1/1974 Gregori
3,813,839 A 6/1974 Simpson et al.
3,822,557 A 7/1974 Frederick
3,886,705 A 6/1975 Cornland
3,951,294 A 4/1976 Wilson
3,959,940 A 6/1976 Ramberg
3,991,636 A 11/1976 Devillers
4,023,374 A 5/1977 Colbert et al.
4,060,945 A 12/1977 Wilson
4,104,837 A 8/1978 Naito
4,106,233 A 8/1978 Horowitz
4,114,388 A 9/1978 Straub
4,162,640 A 7/1979 Arnold
4,180,956 A 1/1980 Gross
4,182,087 A 1/1980 Schall et al.
4,193,243 A 3/1980 Tiner
4,276,730 A 7/1981 Lewis
4,299,070 A 11/1981 Oltmanns et al.
4,332,119 A 6/1982 Toews
4,351,870 A 9/1982 English
4,383,674 A 5/1983 Fricker
4,385,850 A 5/1983 Bobath
4,386,543 A 6/1983 Walker, Jr.
4,430,831 A 2/1984 Kemp
4,433,522 A 2/1984 Yerushalmi
4,434,597 A 3/1984 Fischer
4,508,310 A 4/1985 Schultz
4,532,745 A 8/1985 Kinard
4,543,764 A 10/1985 Kozikowski
4,550,539 A 11/1985 Foster
4,553,875 A 11/1985 Casey
4,575,985 A 3/1986 Eckenrodt
4,581,864 A 4/1986 Shvakhman et al.
4,606,167 A 8/1986 Thorne
4,633,558 A 1/1987 Spaulding
4,664,560 A 5/1987 Cortlever
4,695,033 A 9/1987 Imaeda et al.
4,703,602 A 11/1987 Pardo
4,731,964 A 3/1988 Phillips
4,736,563 A * 4/1988 Bilhorn ..... E04D 3/14 52/460
4,731,971 A 5/1988 Terkl
4,742,665 A 5/1988 Baierl
4,754,668 A 7/1988 Oetiker
4,808,039 A 2/1989 Fischer
4,856,754 A 8/1989 Yokota et al.
4,866,891 A 9/1989 Young
4,892,052 A 1/1990 Zook et al.
4,930,282 A 6/1990 Meadows
4,946,056 A 8/1990 Stannard
4,951,992 A 8/1990 Hockney
4,995,191 A 2/1991 Davis
5,014,480 A 5/1991 Guarriello et al.
5,028,368 A 7/1991 Grau
5,050,362 A 9/1991 Tal et al.
5,058,855 A 10/1991 Ward
5,078,360 A 1/1992 Spera
5,106,233 A 4/1992 Breaux
5,124,102 A 6/1992 Serafini
5,170,605 A 12/1992 Huddle
5,185,193 A 2/1993 Phenicie et al.
5,187,843 A 2/1993 Lynch
5,216,863 A 6/1993 Nessa et al.
5,243,805 A 9/1993 Fricker
5,247,773 A 9/1993 Weir
5,265,750 A 11/1993 Whiteley
5,292,208 A 3/1994 Berger
5,311,718 A 5/1994 Trousilek
5,465,545 A 11/1995 Trousilek
5,489,468 A 2/1996 Davidson
5,491,947 A 2/1996 Kim
5,513,474 A 5/1996 Scharkowski
5,516,863 A 5/1996 Abusleme et al.
5,553,430 A 9/1996 Majnaric et al.
5,591,265 A 1/1997 Tusch
5,608,999 A 3/1997 McNamara
5,625,989 A 5/1997 Brubaker et al.
5,714,045 A 2/1998 Lasa et al.
5,729,944 A 3/1998 De Zen
5,735,097 A 4/1998 Cheyne
5,740,648 A 4/1998 Piccone
5,747,134 A 5/1998 Mohammed et al.
5,758,467 A 6/1998 Snear et al.
5,791,103 A 8/1998 Coolman
5,816,010 A 10/1998 Conn

(56) References Cited

U.S. PATENT DOCUMENTS 5,824,347 A 10/1998 Serafini
5,860,262 A 1/1999 Johnson
5,860,267 A 1/1999 Pervan
5,876,810 A 3/1999 Bodine et al.
5,953,880 A 9/1999 De Zen
5,987,830 A 11/1999 Worley
6,053,666 A 4/2000 Irvine et al.
6,151,856 A 11/2000 Shimonohara
6,161,989 A 12/2000 Kotani et al.
6,167,669 B1 1/2001 Lanc
6,167,672 B1 1/2001 Okitomo
6,178,711 B1 1/2001 Laird et al.
6,185,884 B1 2/2001 Myers et al.
6,189,269 B1 2/2001 De Zen
6,199,340 B1 3/2001 Davis
6,209,278 B1 4/2001 Tychsen
6,212,845 B1 4/2001 De Zen
6,219,984 B1 4/2001 Piccone
6,220,779 B1 4/2001 Warner et al.
6,226,950 B1 5/2001 Davis
6,247,280 B1 6/2001 Grinshpun et al.
6,286,281 B1 9/2001 Johnson
6,293,067 B1 9/2001 Meendering et al.
6,357,196 B1 3/2002 McCombs
6,378,261 B1 4/2002 Agsten
6,387,309 B1 5/2002 Kojima
6,405,508 B1 6/2002 Janesky
6,430,885 B1 * 8/2002 Ito ..... E04F 13/0816 52/282.1
6,435,470 B1 8/2002 Lahham et al.
6,435,471 B1 8/2002 Piccone
6,438,918 B2 8/2002 Moore et al.
6,467,136 B1 10/2002 Graham
6,530,185 B1 3/2003 Scott et al.
6,539,643 B1 4/2003 Gleeson
6,550,194 B2 4/2003 Jackson et al.
6,584,748 B2 7/2003 Bresnahan
6,588,165 B1 * 7/2003 Wright ..... E04F 19/06 52/459
6,622,452 B2 9/2003 Alvaro
6,647,689 B2 11/2003 Pletzer et al.
6,691,976 B2 2/2004 Myers et al.
6,694,692 B2 2/2004 Piccone
6,832,456 B1 12/2004 Bilowol
6,866,445 B2 3/2005 Semler
6,935,081 B2 8/2005 Dunn et al.
7,007,433 B2 3/2006 Boyer
7,188,576 B2 3/2007 Bogard et al.
7,320,201 B2 1/2008 Kitchen et al.
7,406,801 B2 8/2008 Zeng et al.
7,415,801 B2 8/2008 Zeng et al.
7,444,788 B2 11/2008 Morin et al.
7,584,583 B2 9/2009 Bergelin et al.
7,763,345 B2 7/2010 Chen et al.
7,765,762 B2 8/2010 Gulbrandsen et al.
7,818,936 B2 10/2010 Morin et al.
7,901,537 B2 3/2011 Jones et al.
8,071,193 B2 12/2011 Windmöller
8,074,418 B2 12/2011 Thiagarajan et al.
8,316,598 B2 11/2012 Flynn et al.
8,322,102 B2 12/2012 Krieger
8,485,493 B2 7/2013 Wells et al.
8,544,232 B2 10/2013 Wybo et al.
8,555,590 B2 10/2013 Richardson et al.
8,707,648 B2 4/2014 Timko et al.
8,769,904 B1 7/2014 Brandt et al.
8,793,953 B2 8/2014 Richardson et al.
8,806,839 B2 8/2014 Zhou
8,859,898 B2 10/2014 Frye
8,881,483 B2 11/2014 Caboni
8,925,275 B2 1/2015 Meersseman et al.
8,959,871 B2 2/2015 Parenti et al.
8,985,888 B2 3/2015 Kawasaki
8,992,131 B2 3/2015 Castonguay et al.
9,003,737 B2 4/2015 Solomon et al.
9,156,233 B2 10/2015 Dossche et al.
9,206,614 B2 12/2015 Richardson et al.
9,328,517 B2 * 5/2016 Bilge ..... E04F 13/0889
9,328,518 B2 5/2016 Bilge
9,347,226 B2 5/2016 Ouellet
9,441,365 B2 9/2016 Richardson et al.
9,453,345 B2 9/2016 Richardson et al.
9,745,758 B2 8/2017 Baert et al.
9,850,658 B2 12/2017 Ordaz
9,913,083 B2 3/2018 Rosendahl
9,993,340 B2 6/2018 Foroni et al.
10,246,883 B2 4/2019 Derelov
10,287,777 B2 5/2019 Boo
10,400,457 B2 9/2019 Simon
10,480,186 B2 11/2019 Tanguay et al.
10,563,410 B2 2/2020 Horton et al.
10,619,357 B2 4/2020 Segaert et al.
10,731,333 B2 8/2020 Richardson et al.
2003/0005659 A1 1/2003 Moore, Jr.
2003/0085482 A1 5/2003 Sincock et al.
2003/0155683 A1 8/2003 Pietrobon
2004/0010994 A1 1/2004 Piccone
2004/0020149 A1 2/2004 Messiqua
2004/0093817 A1 5/2004 Pujol Barcons
2004/0216408 A1 11/2004 Hohmann, Jr.
2005/0016083 A1 1/2005 Morin et al.
2005/0016103 A1 1/2005 Piccone
2005/0055938 A1 3/2005 Secondino
2006/0179762 A1 8/2006 Thome et al.
2006/0185270 A1 8/2006 Handley et al.
2006/0185291 A1 8/2006 Mathe
2006/0213140 A1 9/2006 Morin et al.
2006/0251865 A1 11/2006 Hintemeder
2007/0028544 A1 2/2007 Messiqua et al.
2007/0044416 A1 3/2007 Van Dijk
2007/0107341 A1 5/2007 Zhu
2007/0193169 A1 8/2007 Emblin
2008/0163664 A1 7/2008 Battenfeld
2008/0168734 A1 7/2008 Degen et al.
2009/0120027 A1 5/2009 Amend
2009/0229214 A1 8/2009 Nelson
2009/0269130 A1 10/2009 Williams
2010/0047608 A1 2/2010 Seccombe
2010/0050552 A1 3/2010 Richardson et al.
2010/0071304 A1 3/2010 Richardson et al.
2010/0212241 A1 8/2010 Holroyd
2010/0251657 A1 10/2010 Richardson et al.
2010/0275547 A1 11/2010 Kamata
2010/0325984 A1 12/2010 Richardson et al.
2011/0000161 A1 1/2011 Aube
2011/0099932 A1 5/2011 Saulce
2011/0131914 A1 6/2011 Richardson et al.
2011/0146189 A1 6/2011 Courey
2011/0277410 A1 11/2011 Richardson
2012/0014745 A1 1/2012 Rosendahl
2012/0056344 A1 3/2012 Richardson et al.
2012/0121337 A1 5/2012 Richardson et al.
2012/0192515 A1 8/2012 Petta
2013/0081345 A1 4/2013 Sheehy
2014/0013563 A1 * 1/2014 Richardson ..... E04F 19/062 29/402.09
2014/0305063 A1 10/2014 Kim
2015/0082724 A1 3/2015 Amend
2016/0289960 A1 10/2016 Darwell
2016/0340899 A1 11/2016 Piccone
2016/0376799 A1 12/2016 Richardson et al.
2017/0218627 A1 8/2017 Neil
2019/0032341 A1 1/2019 Fleet
2020/0131780 A1 4/2020 De Rick

FOREIGN PATENT DOCUMENTS

CA 1316366 4/1993
CA 2097226 11/1994
CA 2141463 8/1996
CA 2070079 6/1997
CA 2170681 8/1997
CA 2218600 6/1998
CA 2215939 8/1999

(56) References Cited

FOREIGN PATENT DOCUMENTS

| | | | | |
|---|---|---|---|---|
| CA | 2226497 | | 10/1999 | |
| CA | 2243905 | | 1/2000 | |
| CA | 2255256 | | 1/2000 | |
| CA | 2244537 | | 2/2000 | |
| CA | 2418885 | | 8/2003 | |
| CA | 2502343 | | 5/2004 | |
| CA | 2502392 | | 5/2004 | |
| CA | 2499450 | | 9/2005 | |
| CA | 2577217 | | 1/2006 | |
| CA | 2629202 | | 4/2008 | |
| CA | 2716118 | | 8/2008 | |
| CA | 2681963 | | 10/2008 | |
| CA | 2654992 | | 8/2010 | |
| CA | 2751134 | | 12/2011 | |
| CA | 2855742 | | 5/2013 | |
| CA | 2810538 | | 9/2014 | |
| CA | 2979918 | A1 | 3/2018 | |
| CH | 317758 | | 1/1957 | |
| CH | 401422 | A | 10/1965 | |
| CH | 669235 | | 2/1989 | |
| CN | 2272915 | Y | 1/1998 | |
| CN | 2529936 | | 1/2003 | |
| CN | 105781053 | A | 7/2016 | |
| DE | 1684357 | | 4/1967 | |
| DE | 1812590 | | 6/1970 | |
| DE | 2062723 | | 8/1972 | |
| DE | 3003446 | | 8/1981 | |
| DE | 3202385 | A1 | 8/1983 | |
| DE | 3234489 | | 3/1984 | |
| DE | 3727956 | | 5/1988 | |
| DE | 3918676 | A1 | 8/1990 | |
| DE | 19503948 | A1 | 8/1996 | |
| DE | 29803155 | | 6/1998 | |
| DE | 20017114 | U1 | 1/2001 | |
| DE | 202014006376 | U1 | 12/2014 | |
| DE | 202018104844 | U1 | 11/2018 | |
| DE | 202018107451 | U1 | 4/2019 | |
| EP | 0025420 | | 3/1981 | |
| EP | 0055504 | | 7/1982 | |
| EP | 0141782 | | 5/1985 | |
| EP | 0179046 | | 4/1986 | |
| EP | 0328228 | A1 * | 8/1989 | |
| EP | 0381339 | A2 | 8/1990 | |
| EP | 0757137 | | 2/1997 | |
| EP | 0735226 | B1 | 8/1999 | |
| EP | 1854937 | A1 | 11/2007 | |
| EP | 2169133 | | 3/2010 | |
| EP | 2799643 | A2 * | 11/2014 | ..... E04B 2/90 |
| EP | 2799643 | A2 | 11/2014 | |
| FR | 0507787 | | 7/1920 | |
| FR | 1381945 | | 11/1964 | |
| FR | 1603005 | | 4/1971 | |
| FR | 2364314 | | 4/1978 | |
| FR | 2535417 | | 5/1984 | |
| FR | 2721054 | | 6/1994 | |
| FR | 2717848 | | 9/1995 | |
| FR | 2733264 | A1 | 10/1996 | |
| FR | 2669364 | | 3/2012 | |
| GB | 137221 | | 1/1920 | |
| GB | 779916 | | 7/1957 | |
| GB | 1243173 | | 8/1971 | |
| GB | 1253447 | | 11/1971 | |
| GB | 1408868 | A * | 10/1975 | ..... E04F 13/0803 |
| GB | 1408868 | A | 10/1975 | |
| GB | 2141661 | | 1/1985 | |
| GB | 2205624 | | 12/1988 | |
| JP | 05133028 | | 5/1993 | |
| JP | 09041612 | | 2/1997 | |
| JP | 2008223335 | | 9/2008 | |
| NL | 2013486 | | 1/2017 | |
| SE | 206538 | | 8/1966 | |
| WO | 8204088 | | 11/1982 | |
| WO | 9500724 | | 1/1995 | |
| WO | 9607799 | | 3/1996 | |
| WO | 9635845 | | 11/1996 | |
| WO | 9743496 | | 11/1997 | |
| WO | 0163066 | | 8/2001 | |
| WO | 0173240 | | 10/2001 | |
| WO | 03006760 | | 1/2003 | |
| WO | 2004088064 | | 10/2004 | |
| WO | 2005040526 | | 5/2005 | |
| WO | 2008074926 | | 6/2008 | |
| WO | 2008119178 | | 10/2008 | |
| WO | 2009059410 | | 5/2009 | |
| WO | 2009092158 | | 7/2009 | |
| WO | 2010012061 | | 2/2010 | |
| WO | 2010037211 | | 4/2010 | |
| WO | 2010078645 | | 7/2010 | |
| WO | 2010094111 | | 8/2010 | |
| WO | 2012003587 | | 1/2012 | |
| WO | 2013075250 | | 5/2013 | |
| WO | 2013102274 | | 7/2013 | |
| WO | 2013102275 | | 7/2013 | |
| WO | 2013177715 | | 12/2013 | |
| WO | 2013188980 | | 12/2013 | |
| WO | 2014121337 | | 8/2014 | |
| WO | 2015081445 | | 6/2015 | |
| WO | 2015149187 | | 10/2015 | |
| WO | 2017113016 | | 7/2017 | |
| WO | 2017/132477 | A1 | 8/2017 | |
| WO | 2019/197393 | A1 | 10/2019 | |

OTHER PUBLICATIONS

Vector Corrosion Technologies Marketing Materials, 2007.
Vector Corrosion Technologies Marketing Materials, 2008.
The Digigraph System, http://www.digigraph-housing.com/web/system.ht, accessed online Jan. 2012.

* cited by examiner

SNAP-TOGETHER STANDOFFS FOR RESTORING, REPAIRING, REINFORCING, PROTECTING, INSULATING AND/OR CLADDING STRUCTURES

RELATED APPLICATIONS

This application is a continuation of Patent Cooperation Treaty (PCT) application No. PCT/CA2018/051666 filed 21 Dec. 2018, which in turn claims priority from (and the benefit under 35 USC 119 in relation to) U.S. application No. 62/610,145 filed on 22 Dec. 2017 and U.S. application No. 62/641,927 filed on 12 Mar. 2018. All of the applications referred to in this paragraph are hereby incorporated herein by reference.

TECHNICAL FIELD

This application relates to methods and apparatus (systems) for restoring, repairing, reinforcing, protecting, insulating and/or cladding a variety of structures. Some embodiments provide stay-in-place liners (or portions thereof) for containing concrete or other curable material(s). Some embodiments provide stay-in-place liners (or portions thereof) which line interior surfaces of supportive formworks and which are anchored to curable materials as they are permitted to cure.

BACKGROUND

Concrete is used to construct a variety of structures, such as building walls and floors, bridge supports, dams, columns, raised platforms and the like. Typically, concrete structures are formed using embedded reinforcement bars (often referred to as rebar) or similar steel reinforcement material, which provides the resultant structure with increased strength. Over time, corrosion of the embedded reinforcement material can impair the integrity of the embedded reinforcement material, the surrounding concrete and the overall structure. Similar degradation of structural integrity can occur with or without corrosion over sufficiently long periods of time, in structures subject to large forces, in structures deployed in harsh environments, in structures coming into contact with destructive materials or the like.

FIGS. 1A and 1B show partial cross-sectional views of an exemplary damaged structure 10. Structure 10 includes a first portion (e.g. a wall) 12 having a surface 14 that is damaged in regions 16A, 16B, 16C, 16D. In the illustrated example of FIGS. 1A and 1B, damaged regions 16A, 16B, 16C, 16D represent regions where surface 14 is indented—i.e. the damage to structure 10 has changed the cross-sectional shape of portion 12 in damaged regions 16A, 16B, 16C, 16D.

There is a desire for methods and apparatus for repairing and/or restoring existing structures which have been degraded or which are otherwise in need of repair and/or restoration.

Exemplary structure 10 also includes portions 18A, 18B on opposing sides of portion 12. In the case where portion 12 is a wall, portions 18A, 18B may represent a floor and ceiling, for example. Portions 18A, 18B of structure 10 respectively form inside corners 20A, 20B with portion 12. Portions 18A, 18B constrain the ability to work in a vicinity of portion 12 and, in particular, in a vicinity of surface 14 which is in need of repair and/or restoration. For example, it may not be possible to access surface 14 of portion 12 by moving in one or more directions parallel with surface 14 from one side of portion 18A (or 18B) to the opposing side of portion 18A (or 18B). Instead, it may be necessary or desirable to access surface 14 from a direction normal to surface 14 (e.g. in direction 22 (FIG. 1A)).

There is a general desire to repair and/or restore existing structures wherein there are constraints on the ability to access the portion(s) and/or surface(s) of the existing structures.

Constraints on access to existing structures (and/or portion(s) and/or surface(s) thereof) in need of repair and/or restoration are not limited to constraints imposed by other portions of the same structure, as is the case of exemplary structure 10 of FIGS. 1A and 1B. Access to existing structures may be limited by other constraints, such as, by way of non-limiting example, the ground, a body of water, other structures and/or the like.

Some structures have been fabricated with inferior or sub-standard structural integrity. By way of non-limiting example, some older structures may have been fabricated in accordance with seismic engineering specifications that are lower than, or otherwise lack conformity with, current seismic engineering standards. There is a desire to reinforce existing structures to upgrade their structural integrity or other aspects thereof. There is a corresponding desire to reinforce existing structures wherein there are constraints on the ability to access portion(s) and/or surface(s) of the existing structures.

There is also a desire to protect existing structures from damage which may be caused by, or related to, the environments in which the existing structures are deployed and/or the materials which come into contact with the existing structures. By way of non-limiting example, structures fabricated from metal or concrete can be damaged when they are deployed in environments that are in or near salt water or in environments where the structures are exposed to salt or other chemicals (and/or biochemicals) used to de-ice roads. There is a corresponding desire to protect existing structures wherein there are constraints on the ability to access portion(s) and/or surface(s) of the existing structures.

Previously known techniques for repairing, restoring, reinforcing, protecting, insulating and/or cladding existing structures often are difficult and time-consuming to implement. There is a general desire to repair, restore, reinforce, protect, insulate and/or clad existing structures in a simple and time-efficient manner.

The desire to repair, restore, reinforce and/or protect existing structures is not limited to concrete structures. There are similar desires for existing structures fabricated from other materials.

The foregoing examples of the related art and limitations related thereto are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

One aspect of the invention provides a method for covering at least a portion of a surface of an existing structure with a repair structure. The method includes providing a standoff. The standoff is elongated in a longitudinal direction and operable from an open configuration to a closed configuration. While the standoff is in the open configuration, the standoff is mounted to the existing structure, such that the standoff projects outwardly away from the surface of the existing structure. The standoff is closed to the closed configuration.

The closing of the standoff forms a standoff connector. A cladding panel is coupled to the standoff by forcing the panel, in an inward direction toward the surface of the existing structure, into engagement with the standoff connector of the standoff at a location spaced outwardly apart from the surface of the existing structure by a void.

In some embodiments, the standoff comprises first and second arms connected at transversely spaced apart locations to a base, the first and second arms movable relative to the base such that at least a portion of the first arm is transversely spaced apart from at least a portion of the second arm when the standoff is in the open configuration and wherein the at least a portion of the first arm is transversely closer to the at least a portion of the second arm when the standoff is in the closed configuration. The first and second arms define an outwardly opening standoff opening therebetween when the standoff is in the open configuration.

In some embodiments, in the open configuration, one or more mounting features of the base are accessible from an outward direction via the standoff opening.

In some embodiments, the one or more mounting features comprise one or more apertures defined by the base.

In some embodiments in the open configuration, the first and second arms are moveable relative to the base and move relative to one another.

In some embodiments, in the closed configuration, the first and second arms are fixed relative to the base and relative to one another.

In some embodiments, the first arm extends from the base at a first angle, a, and the second arm extends from the base at a second angle, p.

In some embodiments, in the open configuration, first angle, a, is between approximately 90° and 180° and second angle, p, is between approximately 90° and 180°.

In some embodiments, in the closed configuration, first angle, a, is between approximately 10° and 90° and second angle, p, is between approximately 10° and 90°.

In some embodiments, closing the standoff comprises connecting the first arm to the second arm at a location spaced outwardly apart from the base.

In some embodiments, connecting the first arm to the second arm comprises locking the first arm to the second arm.

In some embodiments, connecting the first arm to the second arm comprises applying force to one or both of the first and second arms to move one or both of the first and second arms with respect to the base and toward one another.

In some embodiments, connecting the first arm to the second arm comprises connecting a first arm connector of the first arm to a second arm connector of the second arm.

In some embodiments, the first arm connector comprises a male connector and the second arm connector comprises a female connector.

In some embodiments, connecting the first arm connector to the second arm connector comprises extending one or more first prongs of the first arm connector into one or more second hooked concavities of the second arm connector.

In some embodiments, the one or more second hooked concavities comprise one or more second acute hooked concavities.

In some embodiments, connecting the first arm connector to the second arm connector comprises extending one or more second prongs of the second arm connector into one or more first hooked concavities of the first arm connector.

In some embodiments, the one or more first hooked concavities comprise one or more first acute hooked concavities.

In some embodiments, connecting the first arm connector to the second arm connector comprises deforming at least a portion of one of the first arm connector and the second arm connector to create restorative deformation forces which at least partially restore a shape thereof to thereby lock the first arm connector and the second arm In some embodiments, connecting the first arm connector to the second arm connector comprises deforming at least a portion of one of the first arm connector and the second arm connector to create restorative deformation forces which at least partially restore a shape thereof to thereby lock the first arm connector and the second arm connector and deformation of the first arm connector comprises deformation of one or more first prongs of the first arm connector and deformation of the second arm connector comprises deformation of one or more of the second prongs of the second arm connector.

In some embodiments, the first arm comprises a first standoff connector component and the second arm comprises a second standoff connector component and, in the closed configuration, the first and second standoff connector components together form the standoff connector.

In some embodiments, the first arm is connected to the base by a first joint and the second arm is connected to the base by a second joint.

In some embodiments, the first joint and the second joint each comprise a different material than the base and the first and second arms.

In some embodiments, the first joint and the second joint are each more flexible than the base and the first and second arms.

In some embodiments, the first joint and the second joint each comprise relieved corners.

In some embodiments, the first joint and the second joint each comprise relieved portions adjacent to corners of each of the first and second joints.

In some embodiments, mounting the standoff to the existing structure comprises passing a fastener through each of the one or more apertures in the base of the standoff.

In some embodiments, the surface of the existing structure is spaced apart from the base of the standoff with one or more spacers. In some embodiments, the spacers are threaded to the fastener. In some embodiments, at least a portion of the fastener is spaced apart from the base by a washer and wherein the washer is supported by one or more pairs of ridges protruding from the base, the ridges extending in the longitudinal direction along at least a portion of the base.

In some embodiments, a curable material is introduced into the void between the cladding panel and the existing structure and the panel acts as at least a portion of a formwork for containing the curable material until the curable material cures to provide a repair structure cladded, at least in part, by the panel.

Another aspect of the invention provides an apparatus for repairing at least a portion of a surface of an existing structure. The apparatus includes a longitudinally extending standoff coupled to the existing structure to project outwardly away from the surface of the existing structure. The standoff is operable from an open configuration to a closed configuration. A cladding panel is forced, in an inward direction toward the surface of the existing structure, into engagement with a standoff connector of the standoff, when the standoff is in the closed configuration, the engaged panel spaced outwardly apart from the surface of the existing structure to provide a void between the cladding panel and the surface of the existing structure. The standoff comprises first and second arms connected at transversely spaced apart locations to a base, the first and second arms movable relative to the base such that at least a portion of the first arm is transversely spaced apart from at least a portion of the second arm when the standoff is in the open configuration and wherein the at least a portion of the first arm is transversely closer to the at least a portion of the second arm when the standoff is in the closed configuration. The first and second arms define an outwardly opening standoff opening therebetween when the standoff is in the open configuration. One or more mounting features of the base are accessible from an outward direction via the standoff opening when the standoff is in the open configuration; and the first arm comprises a first standoff connector component and the second arm comprises a second standoff connector component and the first and second standoff connector components together form the standoff connector when the standoff is in the closed configuration.

Another aspect of the invention provides a method for covering at least a portion of a surface of an existing structure with a repair structure. The method includes providing a standoff. The standoff is elongated in a longitudinal direction and operable from an open configuration to a closed configuration. While the standoff is in the open configuration, the standoff is mounted to the existing structure, such that the standoff projects outwardly away from the surface of the existing structure. The standoff is closed to the closed configuration. The closing of the standoff forms a standoff connector. A first cladding panel and a second cladding panel is coupled to the standoff by forcing the first and second panels, in an inward direction toward the surface of the existing structure, into engagement with the standoff connector of the standoff at a location spaced outwardly apart from the surface of the existing structure by a void.

In some embodiments, forcing the first and second panels, in an inward direction toward the surface of the existing structure comprises forcing a first panel connector component of the first panel in the inward into the standoff connector and forcing a second panel connector component of the second panel in the inward direction into the standoff connector.

In some embodiments, forcing the first and second panels, in an inward direction toward the surface of the existing structure comprises forcing a first panel connector component of the first panel in the inward into the standoff connector and then forcing a second panel connector component of the second panel in the inward direction into the standoff connector.

In some embodiments, an integrated cover of the second panel is extended into a recess of the first panel as the second panel connector component is forced in the inward direction into the standoff connector.

In some embodiments, the integrated cover of the second panel overlaps with the first panel in the inward direction.

In some embodiments, a seal is located between a surface of the recess of the first panel and the integrated cover of the second panel.

Another aspect of the invention provides an apparatus for repairing at least a portion of a surface of an existing structure. The apparatus includes a longitudinally extending standoff coupled to the existing structure to project outwardly away from the surface of the existing structure. The standoff is operable from an open configuration to a closed configuration. A first cladding panel and a second cladding panel are each forced in an inward direction toward the surface of the existing structure into engagement with a standoff connector of the standoff when the standoff is in the closed configuration. The first and second engaged panels are spaced outwardly apart from the surface of the existing structure to provide a void between the cladding panel and the surface of the existing structure. The standoff comprises first and second arms connected at transversely spaced apart locations to a base, the first and second arms movable relative to the base such that at least a portion of the first arm is transversely spaced apart from at least a portion of the second arm when the standoff is in the open configuration and wherein the at least a portion of the first arm is transversely closer to the at least a portion of the second arm when the standoff is in the closed configuration. The first and second arms define an outwardly opening standoff opening therebetween when the standoff is in the open configuration. One or more mounting features of the base are accessible from an outward direction via the standoff opening when the standoff is in the open configuration. The first arm comprises a first standoff connector component and the second arm comprises a second standoff connector component and the first and second standoff connector components together form the standoff connector when the standoff is in the closed configuration.

Another aspect of the invention provides a tool for closing a standoff mounted to an existing structure. The tool includes a tool head; a first roller rotatably coupled to the tool head; a second roller rotatably coupled to the tool head; and a handle pivotally connected to the tool head. The first and second rollers are configured to engage and apply force to opposing exterior surfaces of the standoff to thereby close the standoff.

In some embodiments, the first roller is configured to engage a first exterior surface of the standoff and the second roller is configured to engage a second exterior surface of the standoff, the first exterior surface opposing the second exterior surface.

In some embodiments, the tool includes a third roller rotatably coupled to the tool head, the third roller configured to engage the first exterior surface of the standoff and a fourth roller rotatably coupled to the tool head, the fourth roller configured to engage the second exterior surface of the standoff.

Another aspect of the invention provides a method for closing a standoff mounted to an existing structure. The method includes providing a tool, engaging the first and second rollers of the tool with the opposing exterior surfaces of the standoff and moving the tool in a longitudinal direction along the length of the standoff to roll the first and second rollers on the opposing exterior surfaces of the standoff to thereby close the standoff.

Another aspect of the invention provides a tool for coupling a panel to a plurality of standoffs mounted to an existing structure. The tool includes a a tool body; first and second panel tool connectors extending from the tool body, the first and second panel tool connectors configured for connecting to first and second standoffs mounted to the existing structure; first and second protrusions extending from the tool body for applying force to the panel in an inward direction toward the existing structure when the first and second panel tool connectors are connected to the first and second standoffs; and one or more handle features extending from the tool body.

In some embodiments, the first and second protrusions comprise first and second set pins threadably engaged with the tool body.

In some embodiments, the first and second connectors comprise hooked arms.

Another aspect of the invention provides a method for coupling a panel to first and second standoffs mounted to an existing structure. The method includes providing a tool, aligning the panel with the plurality of standoffs, aligning the tool with the panel, moving the tool in the inward direction towards the existing structure to force a first longitudinal portion of the panel into connection with the first and second standoffs, connecting the first panel tool connector to the first standoff and connecting the second panel tool connector to the second standoff, and moving the tool in a longitudinal direction away from the first longitudinal portion of the panel along the length of the panel to couple a remaining longitudinal portion of the panel to the first and second standoffs.

In some embodiments, the first and second protrusions are adjusted to apply a desired force to the panel in the inward direction toward the existing structure.

In some embodiments, moving the tool in the longitudinal direction comprises pulling on the one or more handle features.

Another aspect of the invention provides a tool for coupling a panel to a plurality of standoffs mounted to an existing structure. The tool includes a tool body, a first panel tool connector extending from the tool body, the first panel tool connector configured for connecting to a first standoff mounted to the existing structure, a second panel tool connector extending from the tool body, the second panel tool connector configured for connecting to a second panel mounted to the existing structure, first and second protrusions extending from the tool body for applying force to the panel in an inward direction toward the existing structure when the first and second panel tool connectors are connected to the first and second standoffs, one or more handle features extending from the tool body.

Another aspect of the invention provides a method for coupling a panel to first and second standoffs mounted to an existing structure. The method includes providing a tool, aligning the panel with the plurality of standoffs, aligning the tool with the panel, moving the tool in the inward direction towards the existing structure to force a first longitudinal portion of the panel into connection with the first and second standoffs, connecting the first panel tool connector to the first standoff and connecting the second panel tool connector to the second panel, and moving the tool in a longitudinal direction away from the first longitudinal portion of the panel along the length of the panel to couple a remaining longitudinal portion of the panel to the first and second standoffs.

In addition to the exemplary aspects and embodiments described above, further aspects and embodiments will become apparent by reference to the drawings and by study of the following detailed descriptions.

BRIEF DESCRIPTION OF THE DRAWINGS

Exemplary embodiments are illustrated in referenced figures of the drawings. It is intended that the embodiments and figures disclosed herein are to be considered illustrative rather than restrictive.

DESCRIPTION

Figure 1A:
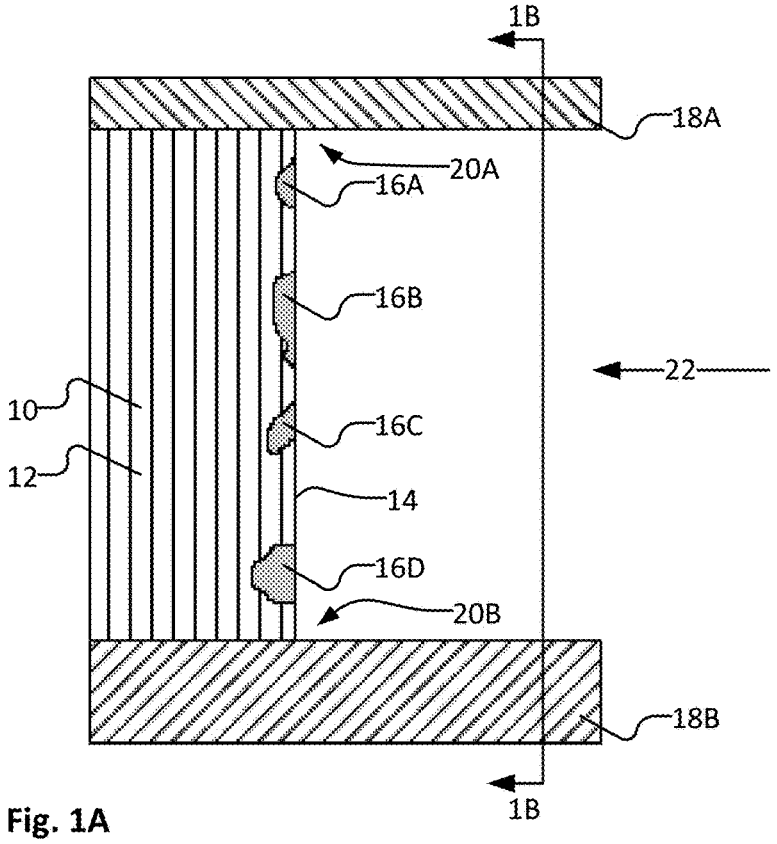
FIGS. 1A and 1B respectively depict partial cross-sectional views of an existing structure along the lines 1A-1A and 1B-1B.

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

Apparatus and methods according to various embodiments may be used to repair, restore, reinforce and/or protect existing structures using concrete and/or similar curable materials. For brevity, in this description and the accompanying claims, apparatus and methods according to various embodiments may be described as being used to "repair" existing structures. In this context, the verb "to repair" and its various derivatives should be understood to have a broad meaning which may include, without limitation, to restore, to reinforce and/or to protect the existing structure. Similarly, structures added to existing structures in accordance with particular embodiments of the invention may be referred to in this description and the accompanying claims as "repair structures". However, such "repair structures" should be understood in a broad context to include additive structures which may, without limitation, repair, restore, reinforce and/or protect existing structures. In some applications which will be evident to those skilled in the art, such "repair structures" may be understood to include structures which insulate or clad existing structures. Further, many of the existing structures shown and described herein exhibit damaged portions which may be repaired in accordance with particular embodiments of the invention. In general, however, it is not necessary that existing structures be damaged and the methods and apparatus of particular aspects of the invention may be used to repair, restore, reinforce or protect existing structures which may be damaged or undamaged. Similarly, in some applications which will be evident to those skilled in the art, methods and apparatus of particular aspects of the invention may be understood to insulate or clad existing structures which may be damaged or undamaged.

One aspect of the invention provides a method for repairing an existing structure to cover at least a portion of the existing structure with a repair structure. The method comprises: mounting one or more standoffs to a surface of the existing structure; coupling one or more cladding panels to the standoffs by forcing the cladding panels into engagement with the standoffs in one or more directions generally normal to the surface of the existing structure and orthogonal to a plane (or tangential plane) of the cladding panels at the locations of the panel connector components such that the panels are spaced apart from the surface of the existing structure to provide a void therebetween; and introducing a curable material to the void between the panels and the existing structure, the panels acting as at least a portion of a formwork for containing the curable material until the curable material cures to provide a repair structure cladded, at least in part, by the panels. Mounting one or more standoffs to at least a portion of the existing structure may comprise providing one or more standoffs that are in an open configuration to provide easy access to mounting features (e.g. apertures) for mounting each standoff to the existing structure (e.g. with one or more fasteners passed through apertures); closing the one or more standoffs by forcing opposing arms of the one or more standoffs toward one another to initially deform a first connector component of a first one of the opposing arms and/or a second connector component of a second one of the opposing arms and then, subsequently, permitting restorative deformation forces to at least partially restore the shape of the deformed first and second connector component(s) to thereby lock the first arm to the second arm such that the standoff is closed. Forcing the cladding panels into contact with the standoffs may comprise initially deforming one or more panel connector components of the standoffs and/or one or more panel connector components of the panels and then, subsequently, permitting restorative deformation forces to at least partially restore a shape of the deformed connector component(s) to thereby lock the panel connector components of the standoff to the panel connector components of the panel.

Another aspect of the invention provides an apparatus for repairing an existing structure to cover at least a portion of a surface of the existing structure with a repair structure. The apparatus comprises a standoff coupled to the existing structure to project outwardly away from the surface of the existing structure. The standoff comprises first and second arms connected to transversely spaced apart locations of a base. The first and second arms are arranged to define an outwardly opening standoff opening therebetween.

The first arm comprises a first standoff connector component and the second arm comprising a second standoff connector component. The standoff is operable between an open configuration in which one or more mounting features defined by the base are accessible via the standoff opening, and a closed configuration in which the first and second standoff connector components together form a standoff connector. The apparatus also comprises a cladding panel forced, in an inward direction toward the surface of the existing structure, into engagement with the standoff connector of the standoff at a location spaced apart from the surface of the existing structure to provide a void between the cladding panel and the surface of the existing structure. The cladding panel is shaped such that the void spaces the cladding panel apart from the surface of the existing structure substantially across a full transverse width of the cladding panel. Curable material is introduced to the void between the panels and the existing structure and the panels act as at least a portion of a formwork for containing the curable material until the curable material cures to provide a repair structure cladded, at least in part, by the panels. The first arm connector components and/or the second arm connector components (or portions thereof) may be shaped such that when the first arm connector components are forced into engagement with the second arm connector components, the first arm connector components and/or the second arm connector components (or portions thereof) are initially deformable and, subsequently, exert restorative deformation forces to at least partially restore their shape to thereby lock the first arm connector components to the second arm connector components. The connector components and/or the panel connector components (or portions thereof) may be shaped such that when the panel connector components are forced into engagement with the standoff connector components in the one or more directions generally normal to the surface of the existing structure, the standoff connector components and/or the panel connector components (or portions thereof) are initially deformable and, subsequently, exert restorative deformation forces to at least partially restore their shape to thereby lock the standoff connector components to the panel connector components.

Aspects of the invention also provide repair structures fabricated using the methods and formwork apparatus described herein. Kits may also be provided in accordance with some aspects of the invention. Such kits may comprise portions of the apparatus according to various embodiments and may facilitate effecting one or more methods according to various embodiments.

Figure 1B:
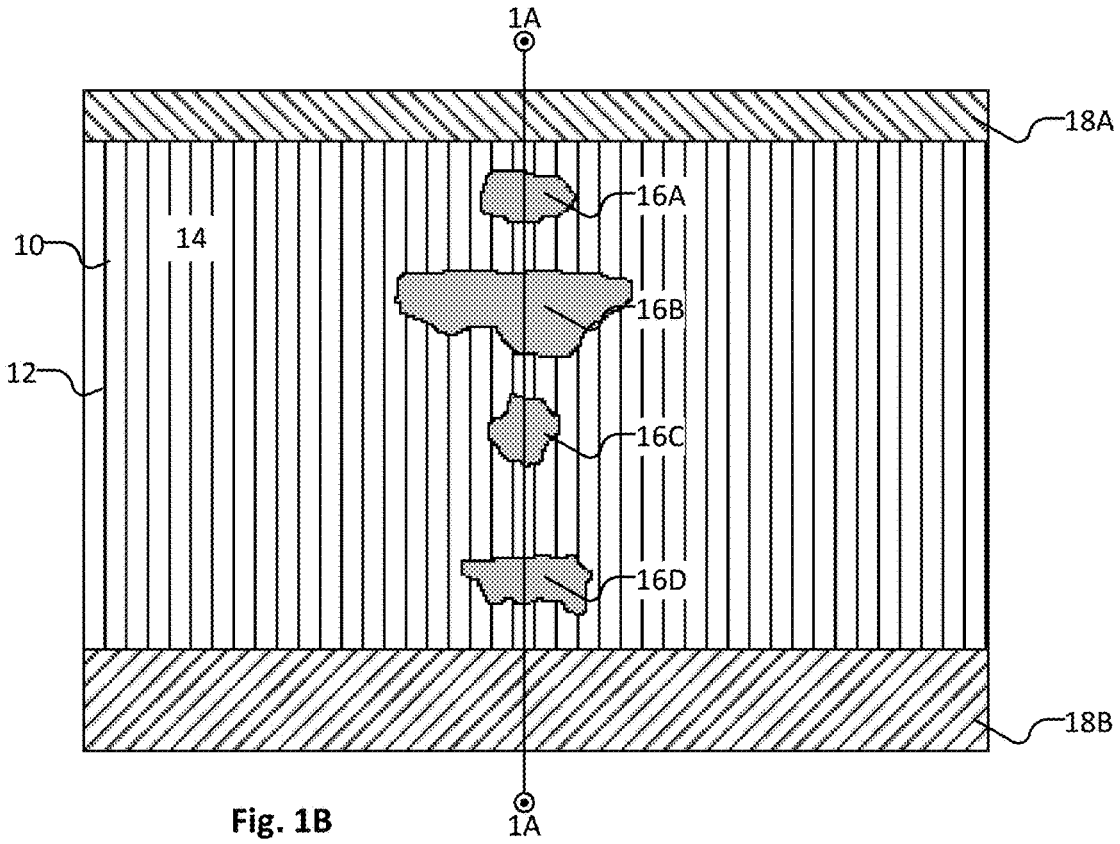

FIGS. 2-8 depict various views of a formwork apparatus 110 (or parts thereof) which may be used to build a repair structure and to thereby repair the FIG. 1 existing structure 10 according to a particular embodiment. As shown best in FIG. 2, formwork 110 of the illustrated embodiment comprises a plurality of standoffs 114, one or more panels 116 and one or more optional connector caps 118. In currently preferred embodiments, standoffs 114, panels 116 and connector caps 118 are fabricated from suitable plastic (e.g. polyvinyl chloride (PVC)) using an extrusion process. It will be understood, however, that standoffs 114, panels 116 and/or cap connectors 118 could be fabricated from other suitable materials, such as, by way of non-limiting example, other suitable plastics, other suitable metals or metal alloys, polymeric materials, fiberglass, carbon fiber material or the like and that standoffs 114, panels 116 and/or connector caps 118 could be fabricated using any other suitable fabrication techniques.

Standoffs 114 are mounted to existing structure 10 such that standoffs 114 extend away from surface 14 thereof. Each standoff 114 is elongated in longitudinal dimension 119. Standoff 114 comprises a base 120 at its edge closest to surface 14 of existing structure 10. First and second arms 132, 134 are connected at transversely spaced apart locations by to base 120. A first component of standoff connector 122 extends from first arm 132 and a second component of standoff connector 122 extends from second arm 134. Together, the first and second components of standoff connector 122 may form standoff connector component 122. In some embodiments, the components of standoff connector 122 are located on one or the other of first and second arms 132, 134 and the arm that does not comprise a component of standoff connector 122 may provide support to standoff connector 122 or may reinforce standoff connector 122 and/or the arm that comprises standoff connector 122.

Standoff 114 may be operable between (or from) an open configuration (illustrated in, for example, FIGS. 4, 5 and 7A) and (or to) a closed configuration (illustrated in, for example, FIGS. 2, 6 7E and 9A to 9J). The open configuration of standoff 114 may facilitate mounting of standoffs 114 on existing structure 10 by facilitating access to space 127 between first and second arms 132, 134 via opening 126. Once standoff 114 is mounted on existing structure 10, standoff 114 may be closed, as described further herein. In the closed configuration, first and second standoff connector components 122A, 122B may form a standoff connector 122 to which a panel 116 may be connected, as described further herein.

In some embodiments, base 120 may be relatively planar (e.g. may extend in transverse direction 121 and longitudinal direction 119) and relatively flat (e.g. without substantial variation in inward-outward direction 123). In other embodiments, base 120 may be curved such that base 120 varies in inward-outward direction 123 across its transverse direction 121 width. Such curvature may allow liquid concrete to enter in between base 120 and surface 14 of existing structure 10 when base 120 abuts existing structure 10 to thereby improve the structural integrity of repair structure 12.

Figure 6A:
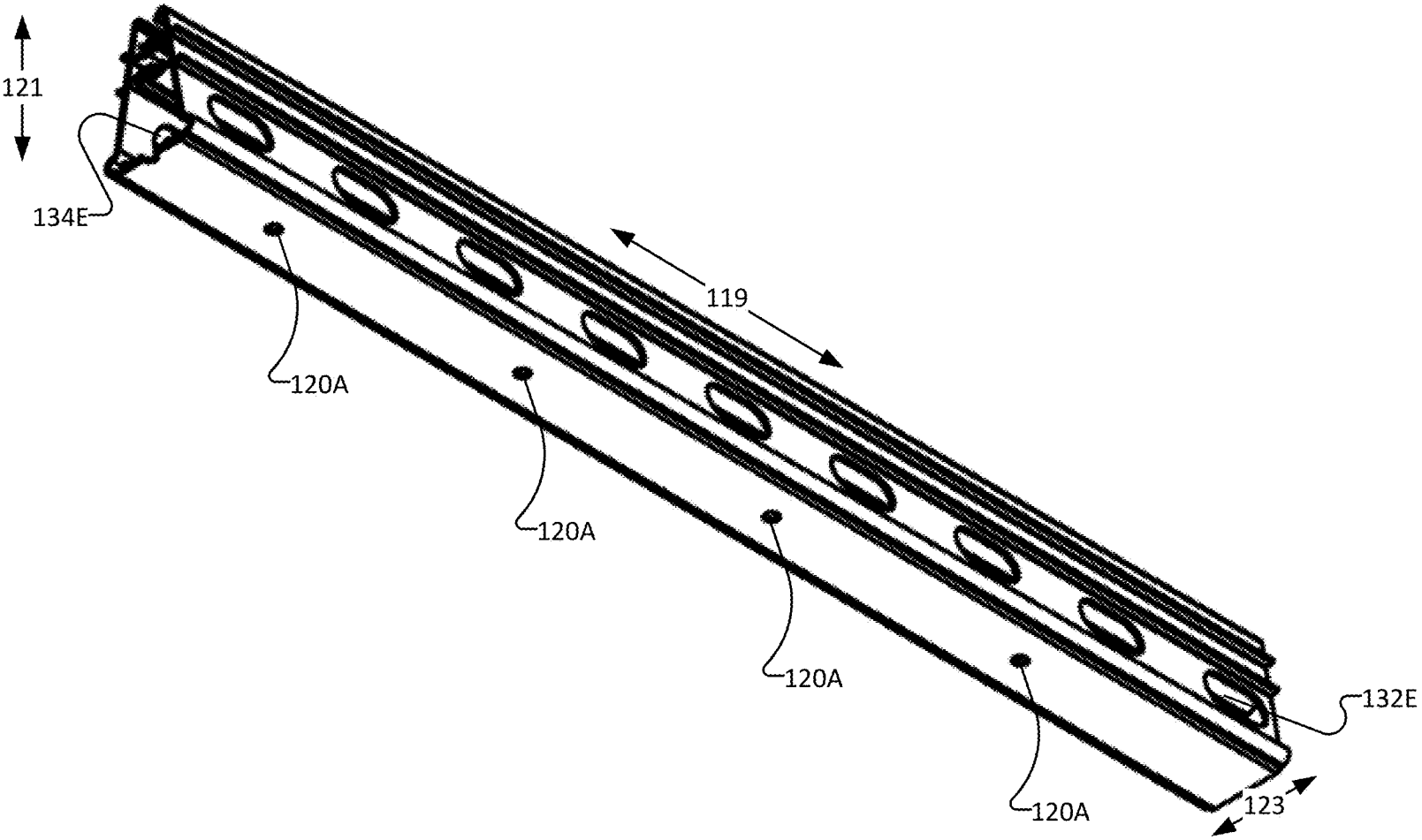
FIG. 6A depicts a perspective view of a standoff of the formwork apparatus for repairing existing structures of FIG. 2.
Figure 6B:
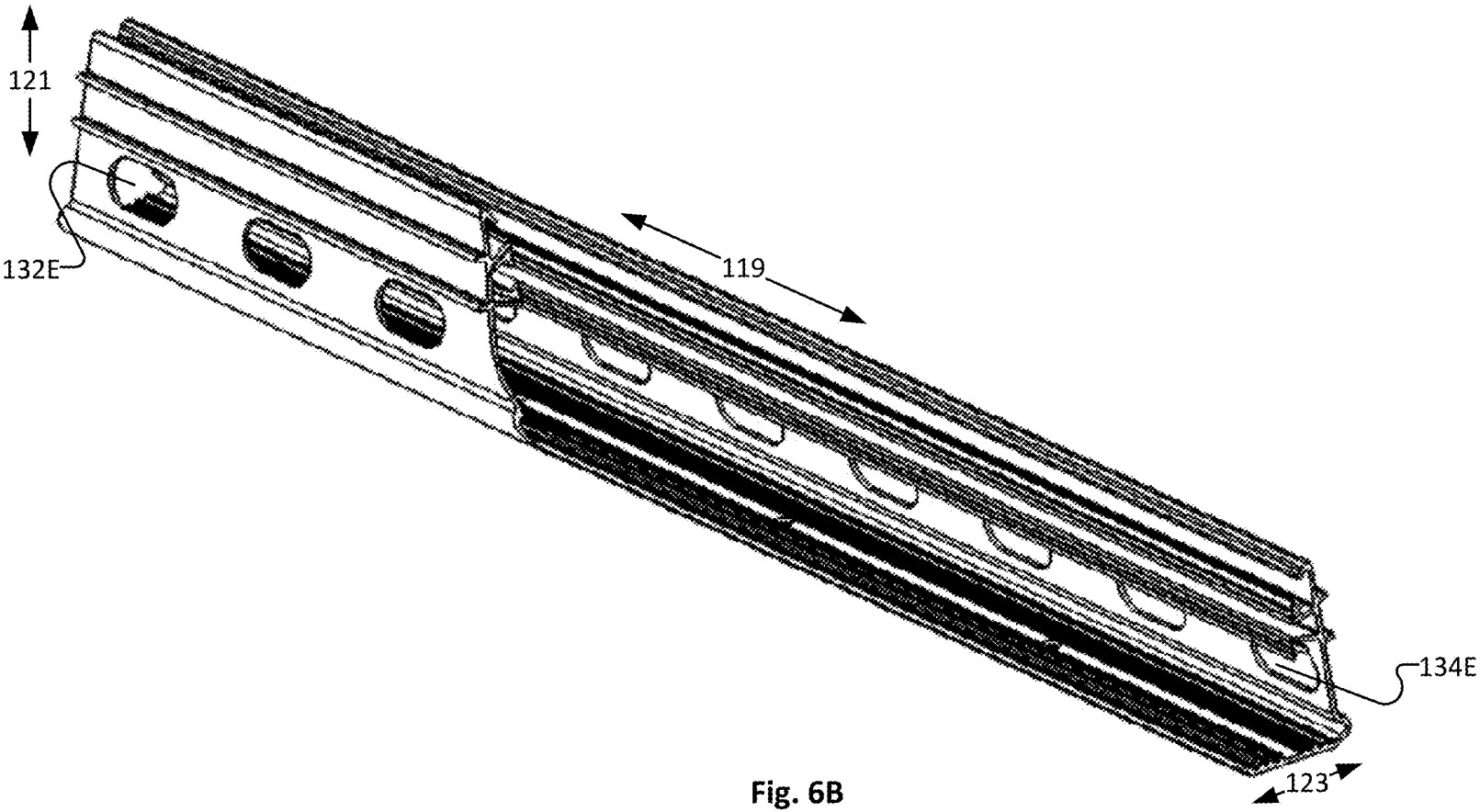
FIG. 6B depicts a partial cutaway perspective view of a standoff of the formwork apparatus for repairing existing structures of FIG. 2.

Base 120 of standoff 114 may comprise one or more mounting features such as apertures 120A, as best shown in FIGS. 6A and 6B. Apertures 120A may receive fasteners 124A for mounting standoff 114 to existing structure 10. Fasteners 124A may comprise any suitable fasteners such as, for example, concrete screws, nuts and bolts, concrete anchors, rebar or the like. In the open configuration, mounting features of base 120 such as apertures 120A may be easily accessed in inward-outward direction 123 via an outwardly opening 126 of standoff connector 114. For example (in the open configuration), a worker may be able to access a fastener 124A in aperture 120A with one or more tools (e.g. wrenches, hammers, drills etc.) to tighten or install fastener 124A without interference by other parts of standoff 114.

Figure 3:
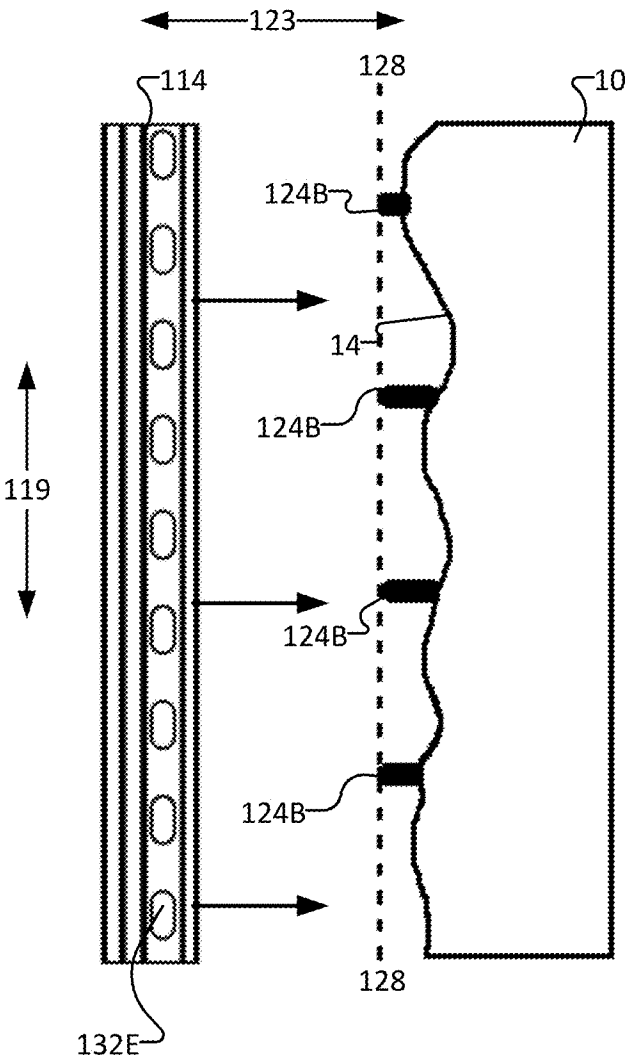
FIG. 3 depicts a side view of a standoff of the formwork apparatus for repairing existing structures of FIG. 2 being mounted on an existing structure according to one embodiment.

Standoff 114 may be mounted to existing structure 10 such that base 120 contacts or abuts surface 14 of existing structure 10. However, surface 14 of existing structure 10 may be uneven (e.g. may vary in inward-outward direction 123) along longitudinal direction 119, as shown in FIG. 3. Spacers 124B may therefore be employed to accommodate such unevenness along longitudinal direction 119. For example, the inward-outward direction 123 dimension of each spacer 124B may be chosen such that a distal end of each spacer 124B (e.g. the end of spacer 124B that is furthest from surface 114) may define a portion of a hypothetical plane 128 as desired. In this way, when base 120 of standoff 114 is mounted against spacers 124B, standoff 114 is parallel with hypothetical plane 128. Hypothetical plane 128 may be a vertical plane to thereby create a new vertical wall surface defined by panels 116. This is not mandatory. Hypothetical plane 128 could be sloped so as to create a new sloped wall surface defined by panels 116, if desired. In this way, standoffs 114 remain straight in longitudinal direction 119 which in turn facilitates coupling of panels 116 to standoffs 114.

Figure 5:
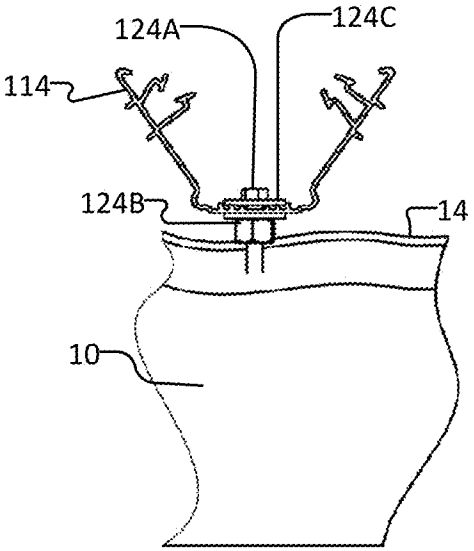
FIG. 5 depicts a top view of a standoff of the formwork apparatus for repairing existing structures of FIG. 2 mounted on an existing structure according to one embodiment.
Figure 4:
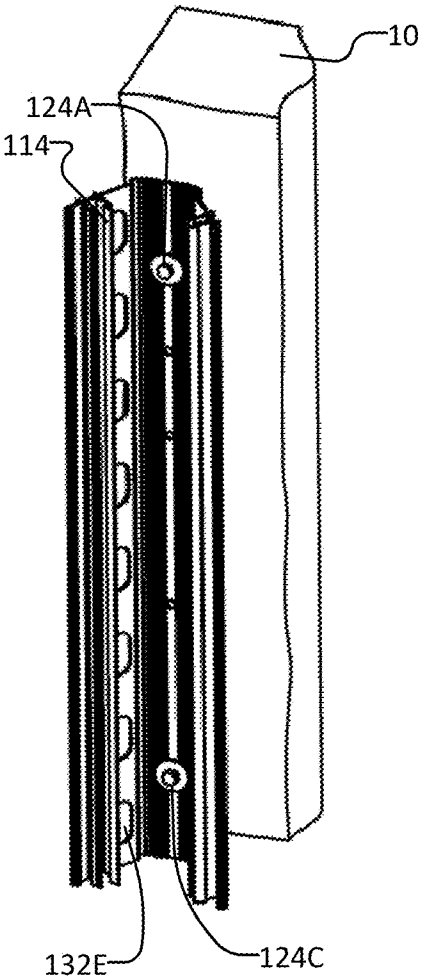
FIG. 4 depicts an elevated perspective view of a standoff of the formwork apparatus for repairing existing structures of FIG. 2 mounted on an existing structure according to one embodiment.

In some embodiments, spacers 124B are complementarily threaded to fasteners 124A, as is depicted in FIG. 5. For example, spacers 124B may comprise a threaded nut. By rotating spacers 124B clockwise or counter-clockwise, the inward-outward direction 123 distance of the distal end of each spacer 124B to surface 14 of existing structure 10 may be adjusted without requiring multiple spacers 124B or spacers 124B of different lengths. In some embodiments, each spacer 124 comprises a pair of threaded nuts to prevent unwanted movement of spacer 124B. In some embodiments, spacers 124B comprise one or more wedges that may be interleaved to space apart standoff 114 from surface 14 of existing structure 10.

In some embodiments, to prevent fastener 124A pulling through aperture 120A, one or more washers 124C may be employed between fastener 124A and base 120. Washers 124C may be flat washers or curved washers. Washers 124C may, for example, comprise metal, polymer or composite materials. In some embodiments, to prevent fastener 124A and/or washer 124C from crushing base 120 or a portion of base 120, one or more ridges 120B may be provided on base 120. Ridges 120B may extend in inward-outward direction 123 from base 120. Ridges 120B may extend along longitudinal direction 119 continuously or may be discontinuous (e.g. ridges 120B may only be present near apertures 120A). Ridges 120B may serve to reinforce base 120 near apertures 120A and may serve to prevent overtightening of fasteners 124A. Ridges 120B may also serve to help center washers 124C around apertures 120A.

Base 120 may comprise one or more pairs of ridges 120B such that each washer 124C contacts at least one pair of ridges 120B. In the FIG. 7A embodiment, base 120 comprises three pairs of ridges 120B-1, 120B-2 and 120B-3. Ridges 120B-2 are spaced apart further than ridges 120B-1 (in transverse direction 121) and are taller (in inward-outward direction 123) than ridges 120B-1. Ridges 120B-3 are spaced apart further than ridges 120B-2 (in transverse direction 121) and are taller (in inward-outward direction 123) than ridges 120B-2. In this way, if a relatively large washer 124C is employed, it may sit on ridges 120B-3 and, if fastener 124A is overtightened, washer 124C will bend or bow prior to base 120 being crushed. Relatively smaller washers 124C may instead sit on ridges 120B-2 or ridges 120B-1 and may possibly abut sides of ridges 120B-3 to prevent unwanted movement of washer 124C in transverse direction 121.

First arm 132 may comprise an interior surface 132A and an exterior surface 132C, Guides 132D for aligning a tool as discussed further herein and for increasing a stiffness of first arm 132 may extend from exterior surface 132C. First arm 132 may define apertures 132E to allow curable material to flow through from an exterior side of first arm 132 to an interior side of first arm 132 (e.g. space 127). First arm 132 may have a first arm length 132B. Second arm 134 may comprise an interior surface 134A, an exterior surface 134C. Guides 134D for aligning a tool as discussed herein and for increasing a stiffness of second arm 134 may extend from exterior surface 134C. Second arm 134 may define apertures 134E to allow curable material to flow through from an exterior side of second arm 134 to an interior side of second arm 134 (e.g. space 127). Second arm 134 may have a length 134B.

Figure 7A:
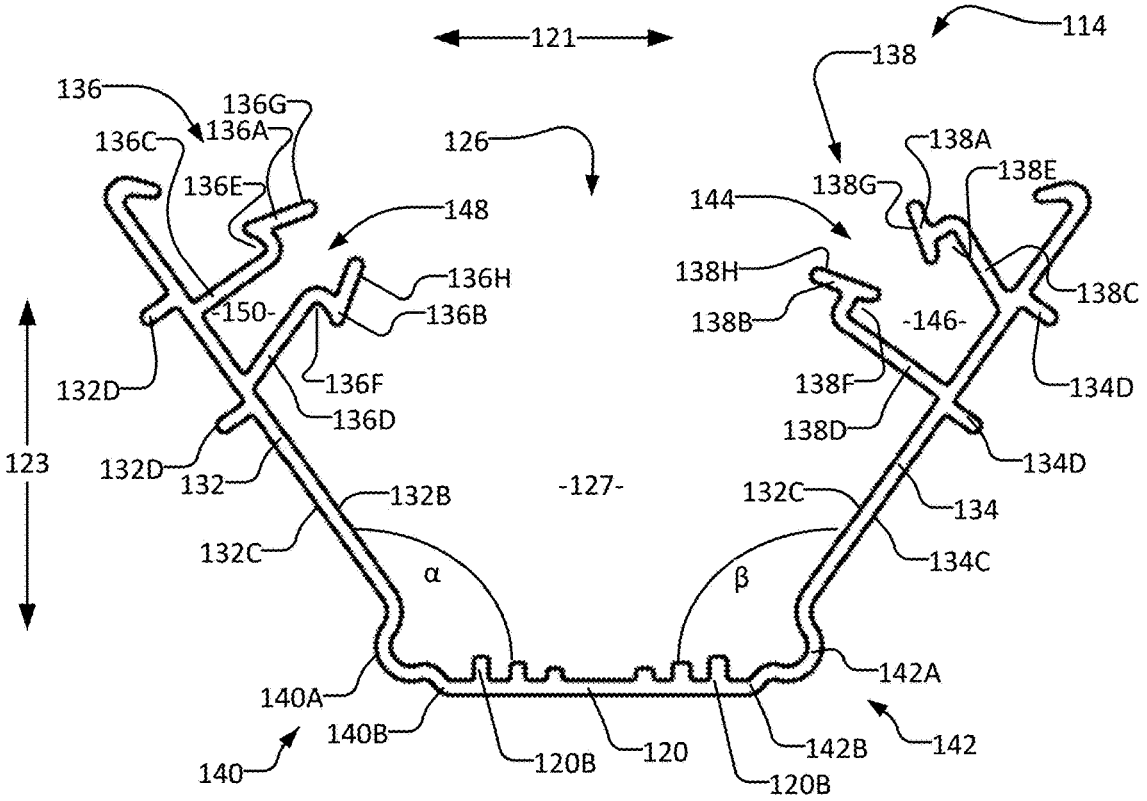
FIGS. 7A to 7E depict magnified top views of a standoff of the formwork apparatus for repairing existing structures of FIG. 2.

First and second arms 132, 134 extend generally in inward-outward direction 123 and/or transverse direction 121 from base 120. First arm 132 may extend from base 120 at an angle, a, and second arm 134 may extend from base 120 at an angle, p as shown in FIG. 7A. To go from the open configuration of standoff 114 to the closed configuration of standoff 114, angle, a, and/or angle, p, may be reduced. For example, in some embodiments, angle, a, and angle, p, are between approximately 90° and 180° when standoff 114 is in the open configuration and angle, a, and angle, p, are between approximately 10° and 90° when standoff 114 is in the closed configuration or, angle, a, and angle, p, are between approximately 120° and 150° when standoff 114 is in the open configuration and angle, a, and angle, p, are between approximately 30° and 70° when standoff 114 is in the closed configuration. Angles $\alpha$ and $\beta$ in the closed configuration may be dependent on a base length 120C, first arm length 132B, second arm length 134B, and/or lengths of first and second arm connectors 136, 138 (e.g. lengths 136I, 136J, 138I, 138J).

First and second arms 132, 134 may be connected to base 120 by first and second joints 140, 142 respectively. First and second joints 140, 142 may permit first and second arms 132, 142 to move relative to one another and/or relative to base 120 when standoff 114 is in the open configuration. Such movement may be facilitated by pivoting, bending, deforming or the like of joints 140, 142 and or one or more portions of base 120 and/or one or more portions of first and second arms 132, 134.

In some embodiments, base 120, first and second joints 140, 142 and first and second arms 132, 134 integral and/or are extruded as one piece and are made of a single material. In some embodiments, first and second joints 140, 142 are co-extruded with base 120 and first and second arms 132, 134 but joints 140, 142 are made of a different material than base 120 and/or first and second arms 132, 134. In some embodiments, base 120 and arms 132, 134 are formed separately and are subsequently attached by joints 140, 142 of a different material. In some embodiments, base 120 and first and second arms 132, 134 are mechanically joined such as by a pivot joint. For example, joints 140, 142 may comprise a more flexible material. In this way, joints 140, 142 may flex (e.g. may allow angles $\alpha$ and $\beta$ to be increased or reduced) easily and repeatedly (e.g. to allow first and second arms 132, 134 to move between the open configuration and the closed configuration of standoff 114) without cracking or breaking.

In some embodiments, first and second joints 140, 142 may comprise first and second relieved portions 140A, 142A adjacent to first and second corners 140B, 142B to facilitate movement of first and second arms 132, 134 between the open configuration and the closed configuration of standoff 114, as shown in FIG. 7A. First and second relieved portions 140A, 142A may comprise curved sections that bend instead of or in addition to bending of first and second corners 140B, 142B to reduce the stress concentration at first and second corners 140B, 142B and to increase the flexibility of first and second joints 140, 142.

In some embodiments, first and second joints 140, 142 may comprise rounded corner joints to reduce the stress concentration at first and second joints 140, 142 and increase the flexibility of first and second joints 140, 142 to facilitate movement of first and second arms 132, 134 between the open configuration and the closed configuration of standoff 114.

Figure 10D:
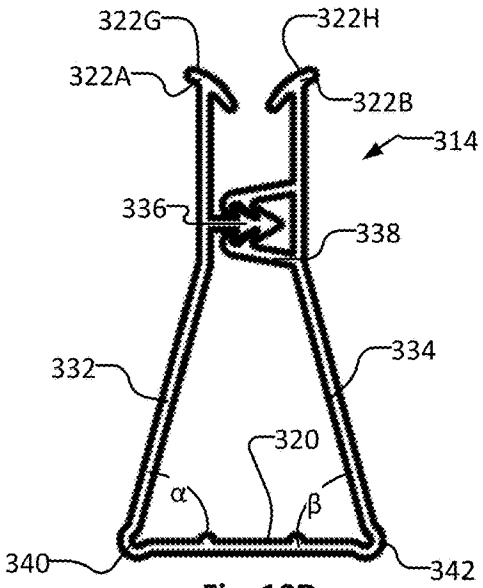
FIGS. 10A to 10D depict magnified views of various standoffs of various formwork apparatuses for repairing existing structures according to various embodiments of the invention.

In some embodiments, first and second joints 140, 142 may comprise relieved corners (e.g. shaped similar to the corner pockets of a billiard table as shown, for example, in FIG. 10D) to reduce the stress concentration at first and second joints 140, 142 and increase the flexibility of first and second joints 140, 142 to facilitate movement of first and second arms 132, 134 between the open configuration and the closed configuration of standoff 114.

First and second arm connector components 136, 138 and the formation of connection 137 between first and second arm connector components 136, 138 are now described in more detail with reference to FIGS. 7A to 7E. The formation of connection 137 may also be referred to as "closing" standoff 114 and similarly, once connection 137 is formed, standoff 114 may be referred to as being "closed". In the closed configuration, first and second arm connector components may be locked to one another by engagement of one or more projections, prongs or the like into one or more hooked concavities, as described further herein. In some embodiments, such locking may be characterized in that arms 132, 134 may not be substantially forced apart without damaging one or more of arms 132, 134 and first and second arm connectors 136, 138 and/or otherwise interfering with connection 137 once connection 137 is formed.

As can be seen from FIGS. 7A to 7E, first arm connector component 136 comprises a pair of first hooked prongs 136A, 136B which initially extend away from first arm interior surface 132A of first arm 132 on spaced apart first projections 136C, 136D, respectively and which curve back toward first arm interior surface 132A to provide corresponding first hook concavities 136E, 136F. First hooked prongs 136A, 136B of first arm connector component 136 also comprise first beveled surfaces 136G, 136H which are beveled to extend toward one another as they extend away from first arm interior surface 132A of first arm 132.

Second arm connector component 138 also comprises a pair of second hooked prongs 138A, 138B which initially extend away from second arm interior surface 134A of second arm 134 on spaced apart second projections 138C, 138D, respectively and which curve back toward second arm interior surface 134A to provide corresponding second hook concavities 138E, 138F. Second hooked prongs 138A, 138B of second arm connector component 138 also comprise second beveled surfaces 138G, 138H which are beveled to extend away from one another as they extend away from second arm interior surface 134A of second arm 134.

Distal first projection 136C (e.g. the first projection more distal from base 120) may have a distal first projection length 136I while proximal first projection 136D (e.g. the first projection more proximal to base 120) may have a proximal first projection length 136J. In some embodiments, distal first projection length 136I is less than proximal first projection length 136J. Similarly distal second projection 138C (e.g. the second projection more distal from base 120) may have a distal second projection length 138I while proximal second projection 138D (e.g. the second projection more proximal to base 120) may have a proximal second projection length 138J. In some embodiments, distal first projection length 136I is less than proximal first projection length 136J and distal second projection length 138I is less than proximal second projection length 138J. Such disparity may facilitate formation of connection 137 in embodiments where angles $\alpha$ and $\beta$ are less than 90° when connection 137 is formed, since interior surfaces 132A, 134A of first and second arms 132, 134 are closer to one another near distal first projection 136C and distal second projection 138C than near proximal first projection 136D and proximal second projection 138D. Such disparity may therefore reduce stresses on first and second arm connector components 132, 134 when connection 137 to thereby improve retention of connection 137.

In some embodiments one or more of first projections 136C, 136D and second projections 138C, 138D define apertures (not depicted) for receiving rebar and/or allowing curable material to flow through.

Some or all of first and second hooked prongs 136A, 136B, 138A, 138B are resiliently deformable such that they can be elastically deformed and exhibit restorative deformation forces which tend to restore first and second hooked prongs 136A, 136B, 138A, 138B to their original shapes and/or positions. Additionally or alternatively, some or all of first and second projections 136C, 136D, 138C, 138D are resiliently deformable such that they can be elastically deformed and exhibit restorative deformation forces which tend to restore first and second projections 136C, 136D, 138C, 138D to their original shapes and/or positions.

Figure 7B:
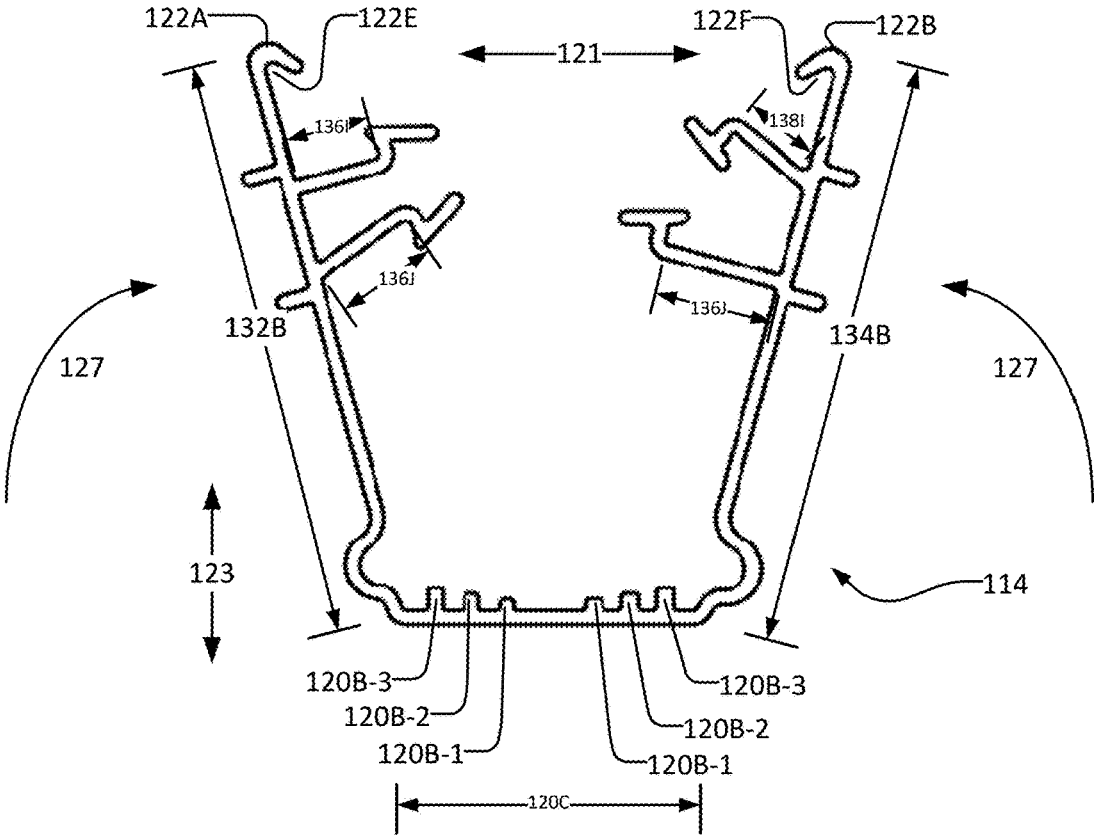
Figure 7E:
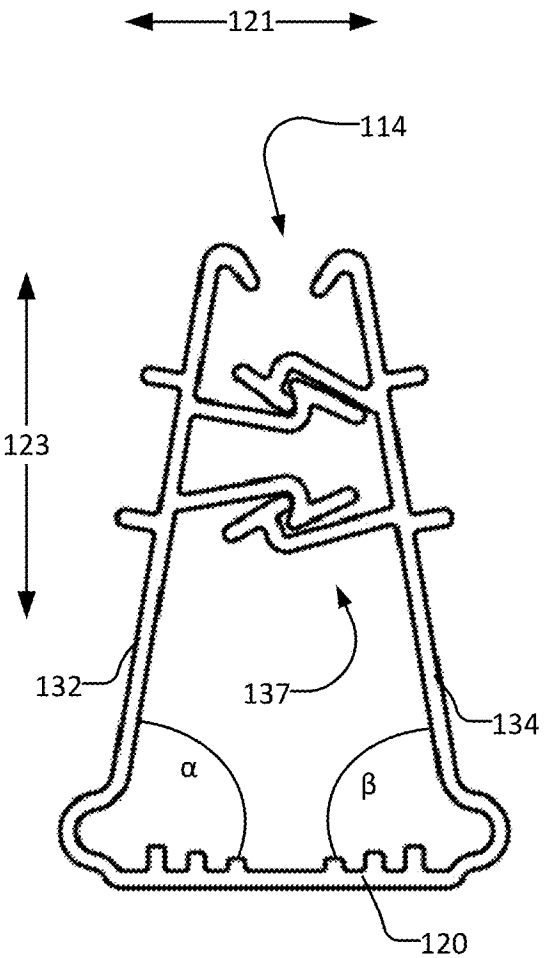
Figure 7D:
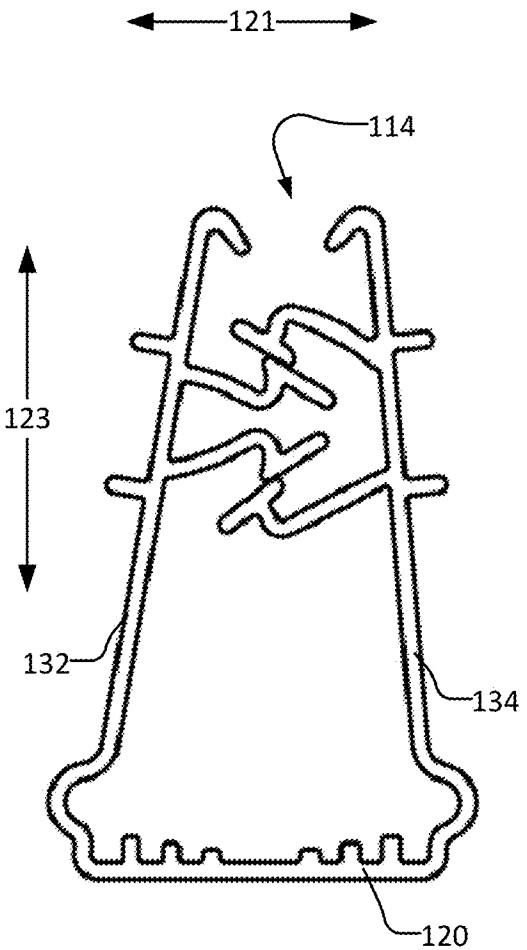
Figure 7C:
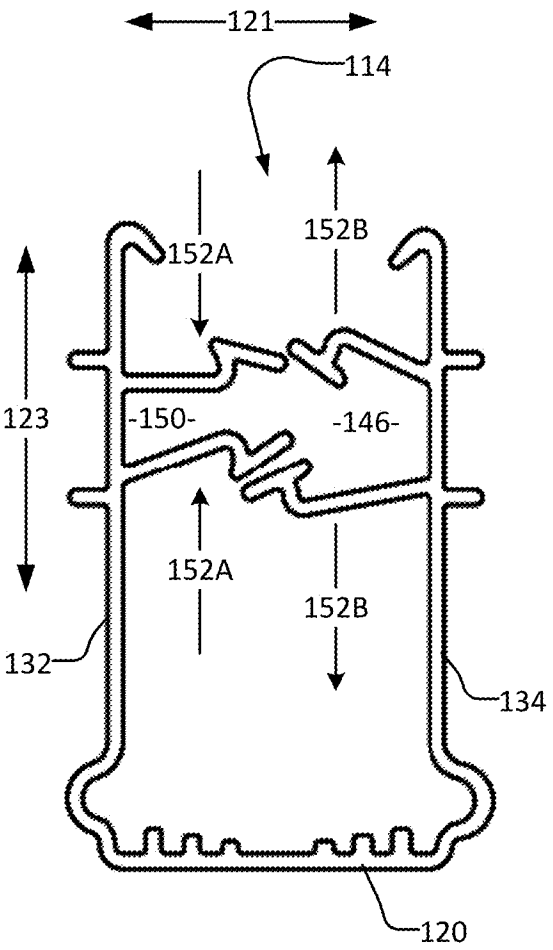

As seen best from FIG. 7E, connection 137 is made when:

first hooked prong 136A of first arm connector component 136 engages complementary second hooked prong 138A of second arm connector component 138 such that first hooked prong 136A extends into and terminates in second hook concavity 138E of second arm connector component 138 and second hooked prong 138A extends into and terminates in first hook concavity 136E of first arm connector component 136; and first hooked prong 136B of first arm connector component 136 engages complementary second hooked prong 138B of second arm connector component 138 such that first hooked prong 136B extends into and terminates in second hook concavity 138F of second arm connector component 138 and second hooked prong 138B extends into and terminates in first hook concavity 136F of first arm connector component 136.

In some embodiments, hooked concavities 136E, 136F, 138E, 138F may each define a respective acute angle hooked concavity (e.g. a hooked concavity defining an angle less than 90°) to better retain hooked prongs 136A, 136B, 138A, 138B therein.

The process of coupling first arm connector component 136 to second arm connector component 138 involves forcing first arm 132 and second arm 134 toward one another (e.g. generally in direction 127 as shown in FIG. 7B) to reduce angles $\alpha$ and $\beta$. In the FIGS. 7A to 7E embodiment, coupling first arm connector component 136 to second arm connector component 138 involves aligning first arm connector component 136 with an opening 144 defined between second hooked prongs 138A, 138B of second arm connector component 138. As first arm 132 and second arm 134 are forced toward one another, first beveled surface 136G abuts against second beveled surface 138G and first beveled surface 136H abuts against second beveled surface 138H (see FIGS. 7C and 7D).

Under continued application of force (see FIGS. 7D and 7E), first beveled surface 136G slides against second beveled surface 138G and first beveled surface 136H slides against second beveled surface 138H as first arm connector 136 passes through opening 144 and into space 146, such that abutment between first beveled surface 136G and second beveled surface 138G and first beveled surface 136H and second beveled surface 138H causes:

deformation of first hook prongs 136A, 136B, which widens opening 148; and/or deformation of first projections 136C, 136D, which widens opening 148; and/or deformation of second hook prongs 138A, 138B, which widens opening 144; and/or deformation of second projections 138C, 138D, which widens opening 144.

More particularly, first hooked prong 136A of first arm connector component 136 deforms in a direction 152A toward space 150, first hooked prong 136B of first arm component 136 deforms in a direction 152A toward space 150, second hooked prong 138A of second arm connector component 138 deforms in a direction 152B away from space 146, and/or second hooked prong 138B of second arm connector component 138 deforms in a direction 152B away from space 146. This deformation permits first arm connector component 136 to pass through opening 144 and extend into space 146.

As first and second arm connector components 136, 138 continue to be forced toward one another (e.g. by deformation of joints 140, 142), first hooked prongs 136A, 136B deform in direction 152A (and/or second hooked prongs 138A, 138B deform in direction 152B) until first hooked prongs 136A, 136B fit past the edges of second hooked prongs 138A, 138B (e.g. beveled surfaces 136G, 136H move past the edges of beveled surfaces 138G, 138H) and first arm connector component 136 is inserted into space 146. At this point, restorative deformation forces (e.g. elastic forces which tend to restore first and/or second arm connector components 136, 138 to, or closer to, their original, non-deformed, shapes) causes first hooked prongs 136A, 136B to move back in direction 152B such that first hooked prongs 136A, 136B extend into second hook concavities 138E, 138F of second arm connector component 138. Similarly, restorative deformation forces cause second hooked prongs 138A, 138B to move back in direction 152A such that second hooked prongs 138A, 138B extend into first hook concavities 136E, 136F of first arm connector component 138. Connection 137 is thereby formed (see FIG. 7E).

In some embodiments, first and second hooked prongs 136A, 136B, 138A and/or 138B are deformed during formation of connection 137, resulting in the creating of restorative deformation forces. First and second arm connector components 136, 138 are shaped such that the restorative deformation forces associated with the deformation of hooked prongs 136A, 136B, 138A and/or 138B are maintained after the formation of connection 137—i.e. after the formation of connection 137, hooked prongs 136A, 136B, 138A and/or 138B are not restored all the way to their original non-deformed shapes, resulting in the existence of restorative deformation forces after the formation of connection 137. Such restorative deformation forces may tend to cause hooked prongs 136A, 136B, 138A, 138B to remain extended into hooked concavities 136E, 136F, 138E, 138F to thereby lock first arm connector 136 to second arm connector 138

In some embodiments, first joint 140 and/or second joint 142 are deformed during formation of connection 137, resulting in the creating of restorative deformation forces. First joint 140 and/or second joint 142 are shaped such that the restorative deformation forces associated with the deformation of first joint 140 and/or second joint 142 are maintained after the formation of connection 137—i.e. after the formation of connection 137 first joint 140 and/or second joint 142 are not restored all the way to their original non-deformed shapes, resulting in the existence of restorative deformation forces after the formation of connection 137. Such restorative deformation forces may tend to cause hooked prongs 136A, 136B, 138A, 138B to remain extended into hooked concavities 136E, 136F, 138E, 138F to thereby lock first arm connector 136 to second arm connector 138.

In some embodiments, first arm 132 and/or second arm 134 are deformed during formation of connection 137, resulting in the creating of restorative deformation forces. First arm 132 and/or second arm 134 are shaped such that the restorative deformation forces associated with the deformation of first arm 132 and/or second arm 134 are maintained after the formation of connection 137—i.e. after the formation of connection 137 first arm 132 and/or second arm 134 are not restored all the way to their original non-deformed shapes, resulting in the existence of restorative deformation forces after the formation of connection 137. Such restorative deformation forces may tend to cause hooked prongs 136A, 136B, 138A, 138B to remain extended into hooked concavities 136E, 136F, 138E, 138F to thereby lock first arm connector 136 to second arm connector 138

Since first arm connector component 136 is forced into and extends into space 146 between second hooked prongs 138A, 138B of second arm connector component 138, first arm connector component 136 may considered to be a "male" connector component corresponding to the "female" second arm connector component 138. In other embodiments, first arm connector component 136 may comprise a female connector component and second arm connector component 138 may comprise a male connector component.

Figure 8:
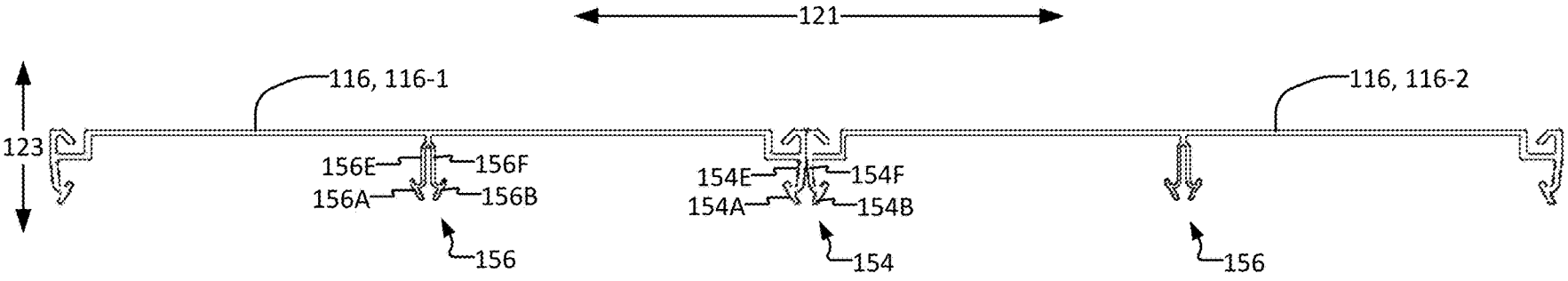
FIG. 8 depicts a top view of panels of the formwork apparatus for repairing existing structures of FIG. 2.

Panels 116 of the illustrated embodiment are generally planar with longitudinal dimensions 119 and transverse widths 121. Panels 116 may have generally uniform cross-sections in the direction of their longitudinal dimensions 119, although this is not necessary. Panels 116 comprise connector components 154, 156 (as shown in FIG. 8) which are complementary to standoff connector components 122 (as can be seen from FIG. 2). Standoff connector components 122 are couplable to corresponding panel connector components 154, 156 to thereby couple panels 116 to standoffs 114 such that panels 116 are positioned at locations spaced apart from existing structure 10 and from surface 14 thereof. When panels 116 are coupled to standoffs 114, the transverse widths 121 of panels 116 may extend generally orthogonally to the inward-outward dimension 123 of standoffs 114.

After standoffs 114 are mounted to structure 10 as described above, the coupling of standoff connector components 122 and panel connector components 154, 156 may be effected by aligning panels 116 with standoffs 114 and forcing panels 116 into engagement with standoffs 114 in inward-outward direction 123 generally normal to surface 14 and generally orthogonal to the plane of panels 116. Forcing panels 116 toward standoffs 114 in directions 22 may initially deform standoff connector components 122 and/or panels connector components 154, 156 and, subsequently, permit restorative deformation forces to at least partially restore the shape of the deformed connector components 122, 154, 156 to thereby lock standoff connector components 122 to panel connector components 154, 156 and couple panels 116 to standoffs 114.

In the illustrated embodiment, there are two types of connections between panels 116 and standoffs 114. Referring back to FIG. 2, formwork 110 comprises a plurality of edge-connecting standoffs 114A, each of which connects a pair of panels 116 in an edge-adjacent relationship and a plurality of interior standoffs 114B, each of which connects to a single panel 116 at a location away from the transverse edges of panel 116. Each panel 116 of the illustrated embodiment comprises edge panel connector components 154 which engage standoff connector components 122 of edge-connecting standoffs 114A and interior connector components 156 which engage standoff connector components 122 of interior standoffs 114B.

Figure 2:
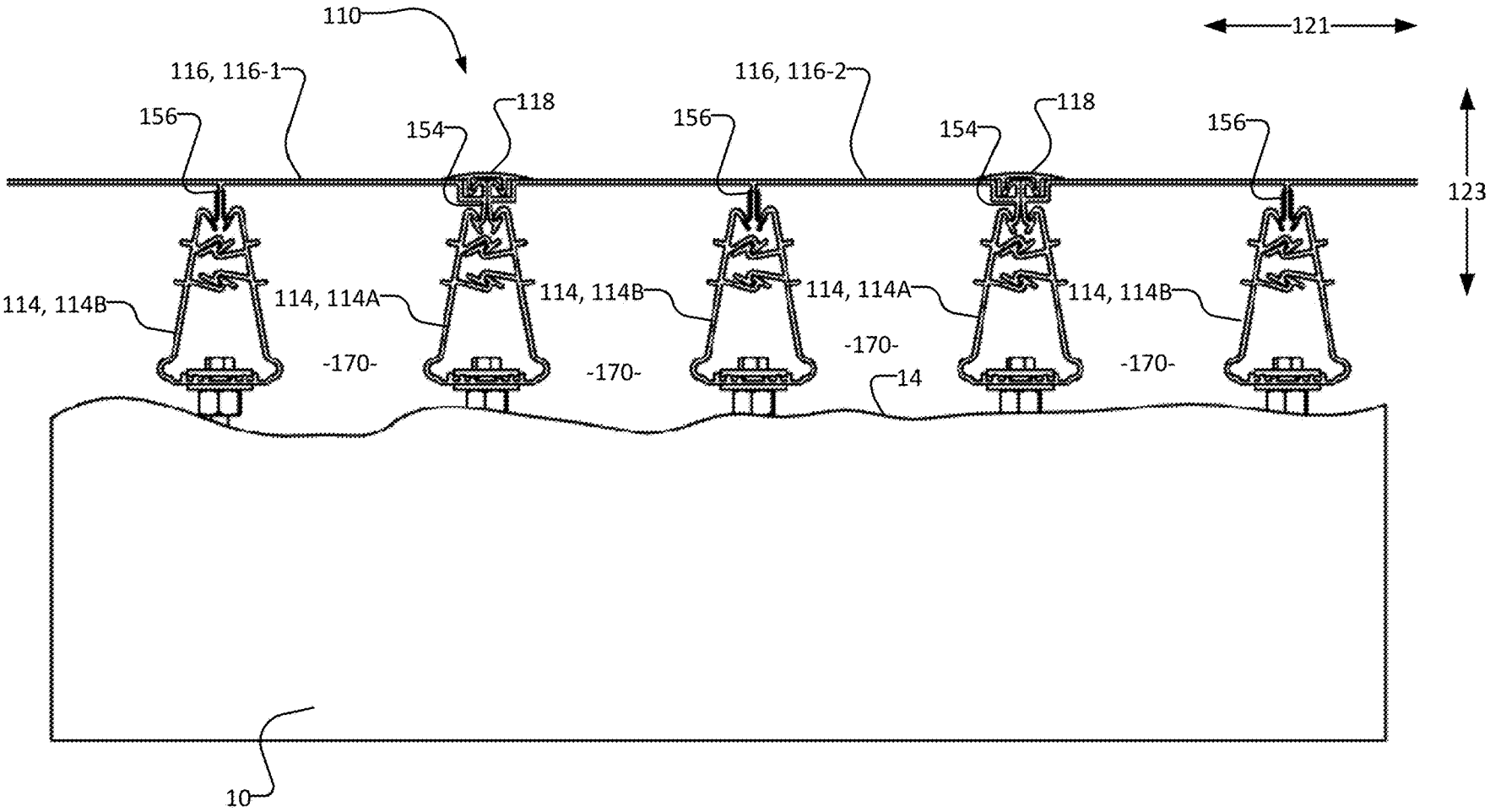
FIG. 2 depicts a top view of a portion of a formwork apparatus for repairing existing structures mounted on an existing structure according to one embodiment.

The engagement of interior connector components 156 to standoff connector components 122 of interior standoffs 114B is shown best in FIG. 2 and the engagement of edge panel connector components 154 to standoff connector components 122 of edge-connecting standoffs 114A is shown best in FIG. 9A to 9J. In the illustrated embodiment, standoff connector components 122 comprise a pair of hooked branches 122A, 122B. In the case of interior standoffs 114B (FIG. 2), hooked branches 122A, 122B of standoff connector component 122 engage complementary hooked branches 156A, 156B on an interior panel connector component 156 of a single panel 116 such that branches 122A, 122B of standoff connector components 122 extend into and terminate in concavities 156E, 156F of panel connector components 156 and branches 156A, 156B of panel connector components 130 extend into and terminate in concavities 122E, 122F of standoff connector component 122.

In the case of edge-connecting standoffs 114A (see FIGS. 9A to 9J):

- hooked branch 122A engages a complementary hooked branch 154A of an edge panel connector component 154 on one edge of a first panel 116-1 such that branch 122A of standoff connector component 122 extends into and terminates in concavity 154E of panel connector component 154 and branch 154A of panel connector component 154 extends into and terminates in concavity 122E of standoff connector component 122; and
- hooked branch 122B engages a complementary hooked branch 154B of an edge panel connector component 154 on an edge-adjacent second panel 116-2 such that branch 122B of standoff connector component 122 extends into and terminates in concavity 154F of panel connector component 154 and branch 154B of panel connector component 154 extends into and terminates in concavity 122F of standoff connector component 122. This engagement of hooked branches 122A, 154A and hooked branches 122B, 154B couples the pair of panels 116-1, 116-2 in an edge-adjacent relationship.

The process of coupling interior panel connector components 156 to standoff connector components 122 of interior standoffs 114B by forcing panels 116 against interior standoffs 114B in inward-outward direction 123 is shown in FIGS. 9A to 9J. Panels 116 may, for example, connect to standoffs 114 (e.g. edge-connecting standoffs 114A and interior standoffs 114B) in one or more of the ways discussed in co-owned Patent Cooperation Treaty application No. PCT/CA2011/050414 which is hereby incorporated herein by reference. Furthermore, standoff connectors 122 and panel connectors 154, 156 may be replaced with any suitable connector discussed in co-owned Patent Cooperation Treaty application No. PCT/CA2011/050414 or known in the art.

Formwork 110 may optionally comprise cap connectors 118. Cap connectors 118 may be connected to a pair of edge-adjacent panels 116 that are coupled to an edge-connecting standoff 114A as described above and as shown in FIGS. 9I and 9J. The connection of cap connectors 118 to a pair of edge-adjacent panels 116 may provide the exterior surface of formwork 110 with a finished (e.g. uniform) appearance and may be useful to reinforce the coupling of edge-adjacent panels 116 to edge-connecting standoff 114A (e.g. to prevent unzipping). Cap connectors 118 may substantially similar to and/or installed in a substantially similar way to the cap connectors discussed in co-owned Patent Cooperation Treaty application No. PCT/CA2011/050414 which is hereby incorporated herein by reference.

Figure 10C:
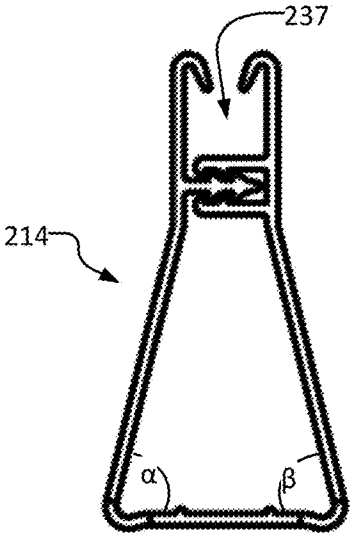
Figure 10B:
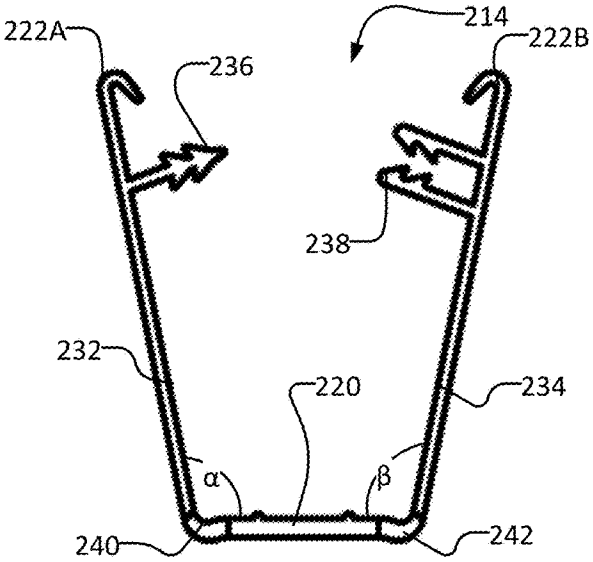
Figure 10A:
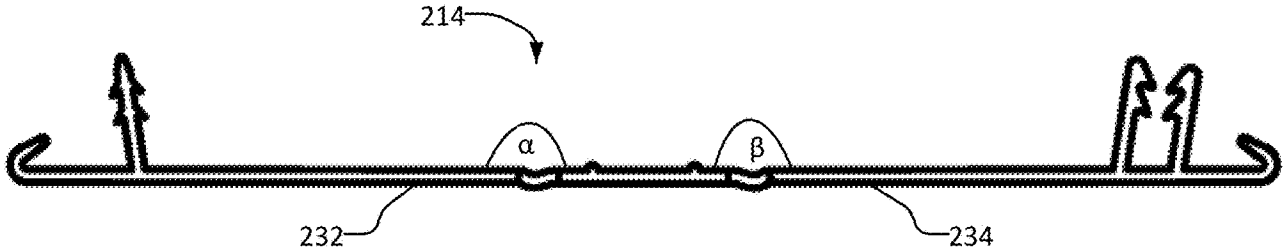

FIGS. 10A to 10C illustrate a standoff 214 according to another embodiment. Standoff 214 is substantially the same as standoff 114, except, for example, as follows, and may be employed as part of formwork 110. Like standoff 114, standoff 214 comprises a base 220 and first and second arms 232, 234 connected to base 220 by joints 240, 242 and extending from base 220 at angles α and β. First and second arm connectors 236, 238 and standoff connector 222 comprise hooked branches 222A, 222B.

Unlike joints 140, 142 as illustrated, joints 240, 242 comprise a different material than base 220 and arms 232, 234. Joints 240, 242 may comprise a material that is more flexible than the material of base 220 and/or arms 232, 234. As can be seen from FIG. 10A, the flexibility of joints 240, 242 allows for angles α and β to be substantially equal to 180° (e.g. ±10°) in the open configuration which may facilitate installation and/or storage and transportation of standoffs 214 and decrease a risk of standoff 214 breaking or cracking at joints 240, 242 when connection 237 is formed between first and second arm connectors 236, 238.

As can be seen from FIGS. 10A to 10C, first and second arm connectors 236, 238 are different from first and second arm connectors 136, 138. Despite the differences between first and second arm connectors 136, 138 and first and second arm connectors 236, 238, connection 237 may be formed in a similar manner to connection 137. For example, each of first and second arm connectors 236, 238 comprises four hooked concavities and four hooked projections such that connection 237 is formed when each of the four hooked projections of first arm connector 236 extends into one of the four hooked concavities of second arm connector 238 and each of the four hooked projections of second arm connector 238 extends into one of the four hooked concavities of first arm connector 236. Second arm connector 238 may be deformed during formation of connection 237 such that restorative deformation causes each of the four hooked projections of first arm connector 236 to extend into one of the four hooked concavities of second arm connector 238 and each of the four hooked projections of second arm connector 238 to extend into one of the four hooked concavities of first arm connector 236.

FIG. 10D illustrates a standoff 314 according to another embodiment. Standoff 314 is substantially the same as standoff 214, except, for example, as follows, and may be employed as part of formwork 110. Like standoff 214, standoff 314 comprises a base 320 and first and second arms 332, 334 connected to base 320 by joints 340, 342 and extending from base 320 at angles α and β. First and second arm connectors 336, 338 and standoff connector 322 comprise hooked branches 322A, 322B.

As can be seen from FIG. 10D hooked branches 322A, 322B are different from hooked branches 122A, 122B (and hooked branches 222A, 222B) in that hooked branches comprise extended beveled portions 322G, 322H as compared to hooked branches 122A, 122B (and hooked branches 222A, 222B). Such extended bevel portions 322G, 322H may facilitate coupling of standoff connectors 322 to panels 116 by facilitating alignment of standoff connectors 322 with panel connectors (e.g. panel connectors 154, 156).

As can be seen from FIG. 10D, joints 340, 342 are different from joints 140, 142 (and joints 240, 242) in that joints 340, 342 comprise relieved corners (e.g. shaped similar to the corner pockets of a billiard table as shown) to reduce the stress concentration at first and second joints 340, 342 and increase the flexibility of first and second joints 340, 342 to facilitate movement of first and second arms 332, 334 between the open configuration and the closed configuration of standoff 314.

Figure 11C:
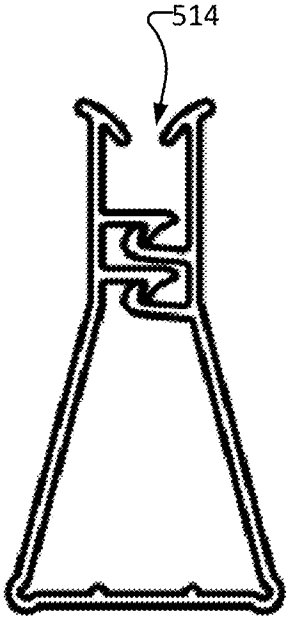
FIGS. 11A to 11C depict magnified views of a standoff of various formwork apparatuses for repairing existing structures according to various embodiments of the invention.
Figure 11B:
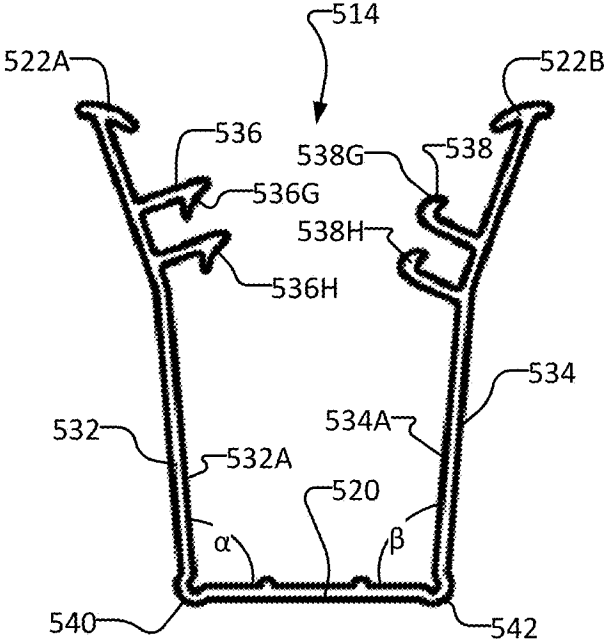
Figure 11A:
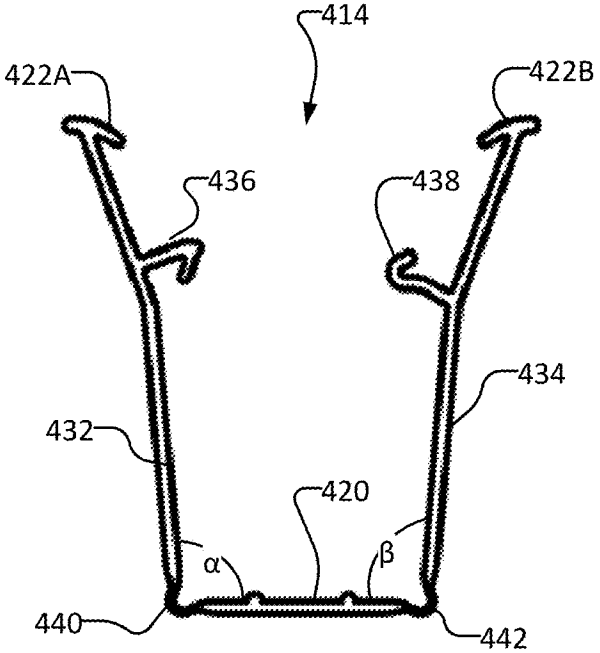

FIG. 11A illustrates a standoff 414 according to another embodiment. Standoff 414 is substantially the same as standoff 314, except, for example, as follows, and may be employed as part of formwork 110. Like standoff 314, standoff 414 comprises a base 420 and first and second arms 432, 434 connected to base 420 by joints 440, 442 and extending from base 420 at angles α and β. First and second arm connectors 436, 438 and standoff connector 422 comprise hooked branches 422A, 422B.

As can be seen from FIG. 11A, first and second arm connectors 436, 438 are different from first and second arm connectors 136, 138 in that first arm connector 436 only comprises one first prong 436A extending from one first projection 436C and second arm connector 438 only comprises one second prong 438A extending from one second projection 438C as compared to a pair of first prongs 136A, 136B extending from a pair of first projections 136C, 136D and a pair of second prongs 138A, 138B extending from a pair of second projections 138C, 138D.

FIGS. 11B and 11C illustrate a standoff 514 according to another embodiment. Standoff 514 is substantially the same as standoff 314, except, for example, as follows, and may be employed as part of formwork 110. Like standoff 314, standoff 514 comprises a base 520 and first and second arms 532, 534 connected to base 520 by joints 540, 542 and extending from base 520 at angles α and β. First and second arm connectors 536, 538 and standoff connector 522 comprise hooked branches 522A, 522B.

As can be seen from FIGS. 11B and 11C, first and second arm connectors 536, 538 are different from first and second arm connectors 136, 138 in that instead of being beveled toward one another as beveled portions 536G, 536H extend away from interior surface 532A like beveled portions 136G, 136H, beveled portions 536G, 536H are bevelled substantially parallel to one another and instead of being beveled apart from one another as beveled portions 538G, 538H extend from interior surface 534A like beveled portions 138G, 138H, beveled portions 538G, 538H are bevelled substantially parallel to one another.

Figure 12B:
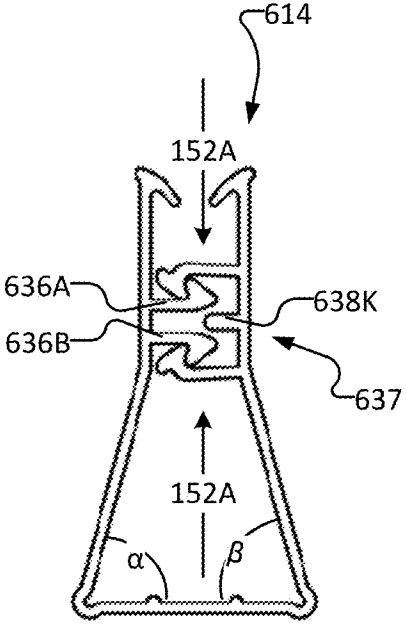
FIGS. 12A and 12B depict magnified views of various standoffs of a formwork apparatus for repairing existing structures according to another embodiment of the invention.
Figure 12A:
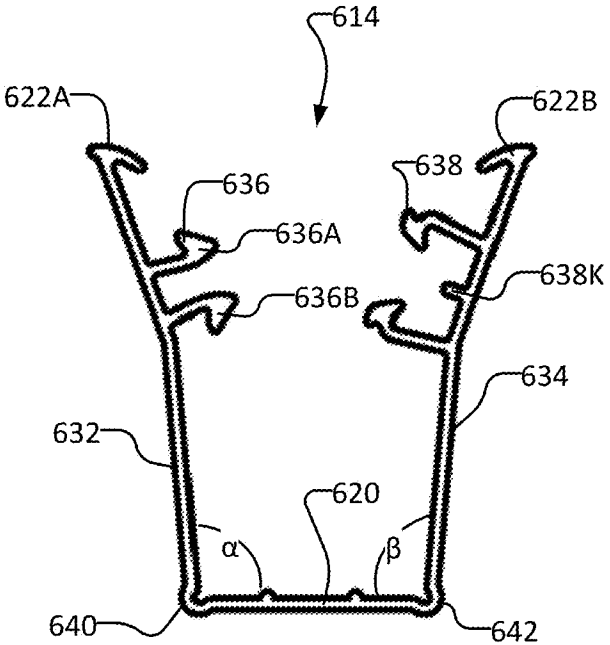

FIGS. 12A and 12B illustrate a standoff 614 according to another embodiment. Standoff 614 is substantially the same as standoff 114, except, for example, as follows, and may be employed as part of formwork 110. Like standoff 114, standoff 614 comprises a base 620 and first and second arms 632, 634 connected to base 620 by joints 640, 642 and extending from base 620 at angles α and β. First and second arm connectors 636, 638 and standoff connector 622 comprise hooked branches 622A, 622B.

As can be seen from FIGS. 12A and 12B, second arm connector 638 is different from second arm connector 138 in that second arm connector 638 comprises a protrusion 638K extending from arm 634 into space 646. Protrusion 638K may serve to prevent first prongs 636A, 636B from moving toward one another in direction 152A when connection 637 is formed and may therefore serve to prevent hooked prongs 636A, 636B from disengaging the hooked connectors of second arm connector 638 and the hooked prongs of second arm connector from disengaging the hooked concavities of first arm connector 636 and release of connection 637.

In the illustrated embodiment, where formwork 110 is used to create a repair structure to repair existing structure 10, standoffs 114, panels 116 and optional cap connectors 118 may extend substantially the same length as the distance between constraining portions 18A, 18B of existing structure 10. In such an example application, after assembly of formwork 110 (including mounting of standoffs 114 to existing structure 10, coupling panels 116 to standoffs 114 and optionally coupling cap connectors 118 to panels 116), concrete may be introduced into the void 170 between surface 14 and panels 116 using a concrete introduction port (not shown). Concrete introduction ports and their use to introduce concrete into a formwork are well known in the art. In embodiments, where formwork 110 does not occupy the entire space between constraints 18A, 18B or where the top of formwork 110 is accessible, concrete may be introduced into void 170 behind formwork 110 via an edge (e.g. a top edge) of formwork 110 without a need for a concrete introduction port.

Liquid concrete introduced into void 170 will flow through apertures 132E, 134E in standoffs 114 (shown in FIGS. 6A and 6B) to encase standoffs 114. Liquid concrete will be retained in void 170 by panels 116 (which are secured to existing structure 10 by standoffs 114), and portions 12, 18A, 18B of existing structure 10. Liquid concrete will also fill damaged regions 16A, 16B, 16C, 16D of existing structure 10. When concrete in void 170 cures, portions of standoffs 114 will be encased in the solidified concrete and will tend to bond the new concrete layer of the repair structure (i.e. concrete in void 170) to existing structure 10. Formwork apparatus 110 acts as a stay-in-place formwork which remains attached to existing structure 10 once the concrete in void 170 solidifies. Accordingly, rather than bare concrete being exposed to the environment, panels 116 clad the exterior of structure 10 such that panels 116 are exposed to the environment. This may be advantageous for a number of reasons. By way of non-limiting example, panels 116 may be more resistant to the environment or substances that contributed to the original degradation of existing structure 10 (e.g. salt water, salts or other chemicals used to de-ice roads or the like). Panels 116 may be more hygienic (e.g. when storing food) or more attractive than bare concrete. Encasing portions of formwork apparatus 110 (e.g. standoffs 114) in concrete within void 170 may provide additional structural integrity to existing structure 10.

In other embodiments, constraining portions 18A, 18B of existing structure 10 may not be present or may not be located in the same places relative to portion 12 so as to retain the concrete in void 170 between panels 116 and surface 14 of existing structure 10. In such cases, it may be necessary or desirable to provide edge formwork components (not explicitly shown) which may be used to retain concrete in void 170 at the edges of panels 116. In particular, it may be necessary or desirable to provide edge formwork components at the bottom and/or the transverse edges of a formwork assembled using standoffs 114, panels 116 and optionally cap connectors 118. Suitable examples of edge formwork components which may be used in connection with the other formwork components described herein are described in Patent Cooperation Treaty application No. PCT/CA2010/000003 and U.S. patent application Ser. No. 12/794,607 which are incorporated herein by reference.

Figure 13:
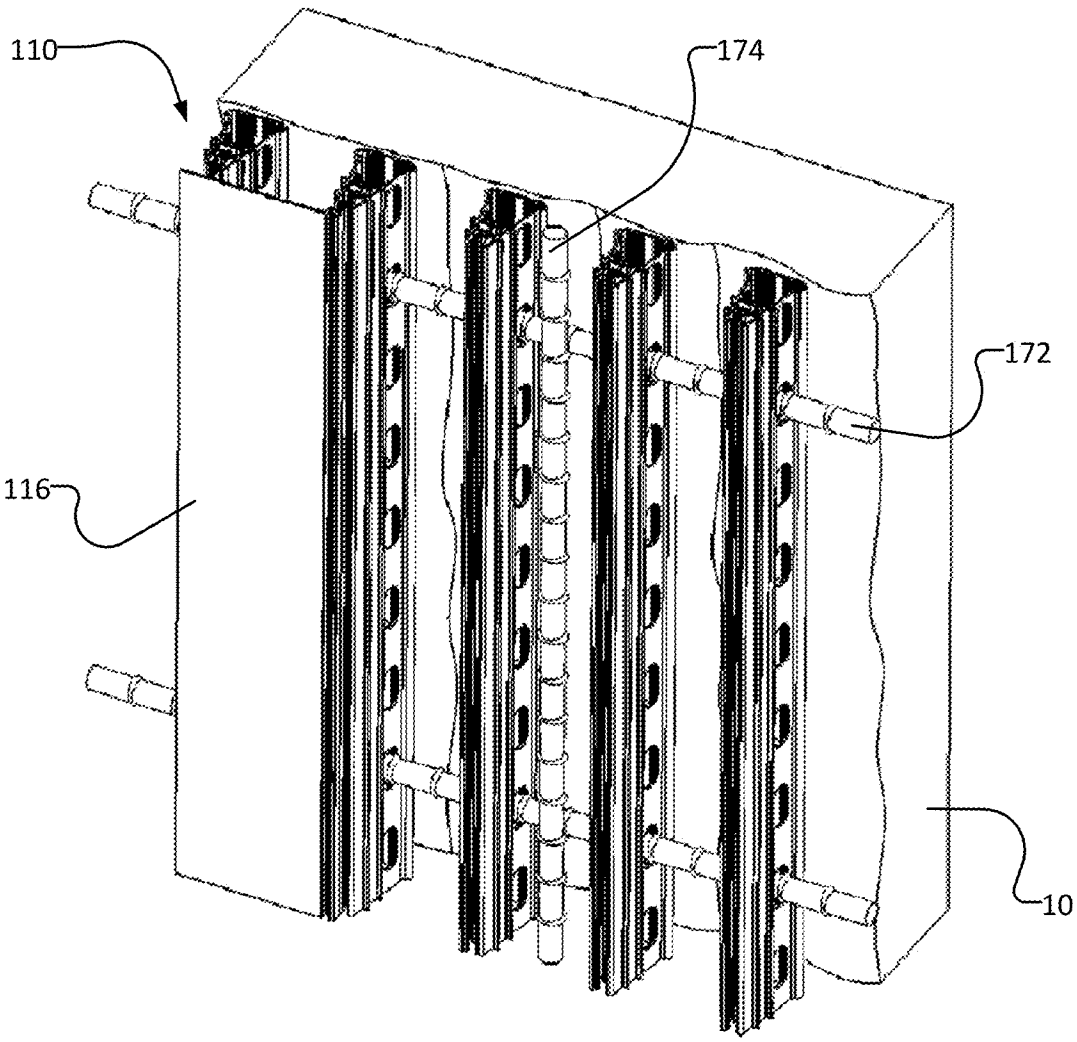
FIG. 13 depicts an elevated perspective view of a portion of a formwork apparatus for repairing existing structures according to another embodiment of the invention.

In some applications, it may be desirable to provide repair structure 10 with extra strength using reinforcement bar (commonly referred to as rebar). FIG. 13 depicts a formwork 110 comprising rebar 172, 164. Prior to coupling panels 116 to standoffs 114, rebar 172 may be extended transversely through aligned apertures 132E, 134E in standoffs 114. Once rebar 172 is extended through apertures 132E, 134E in standoffs 114, orthogonal rebar 174 may be extended in directions parallel with the elongated dimensions of panels 116 and standoffs 114. Orthogonal rebar 174 may be strapped to transversely extending rebar 172 which projects through apertures 132E, 134E of standoffs 114. When concrete is introduced to void 170, rebar 172, 174 will be encased in concrete and will strengthen the corresponding repair structure.

Although not depicted, standoff extenders could be provided between standoffs 114 and panels 116 to increase the inward-outward direction 123 dimension of void 170. Standoff extenders may comprise a first end complementary to standoff connectors 122 and a second end complementary to panel connectors 154, 156. Standoff extenders may also comprise one or more openings to allow liquid concrete to flow through.

Although not depicted, in some embodiments, formwork may comprise sealing members configured to provide substantially liquid tight seals between edge-adjacent panels. Such sealing members may, for example, provide substantially liquid tight seals between connected outer panel connector components, connector caps and/or edge connector components. Examples of sealing members that may be employed as part of formwork 110 or any other embodiment herein are discussed in co-owned Patent Cooperation Treaty application No. PCT/CA2011/050414 which is hereby incorporated herein by reference.

Although not depicted, in some embodiments, systems may be provided to insulate and/or clad existing structures (e.g. existing structure 10). It should be understood that the formworks described herein (e.g. formwork 110) may be modified to include insulation in any suitable manner such as, for example, such manners discussed in co-owned Patent Cooperation Treaty application No. PCT/CA2011/050414 which is hereby incorporated herein by reference.

Figure 14A:
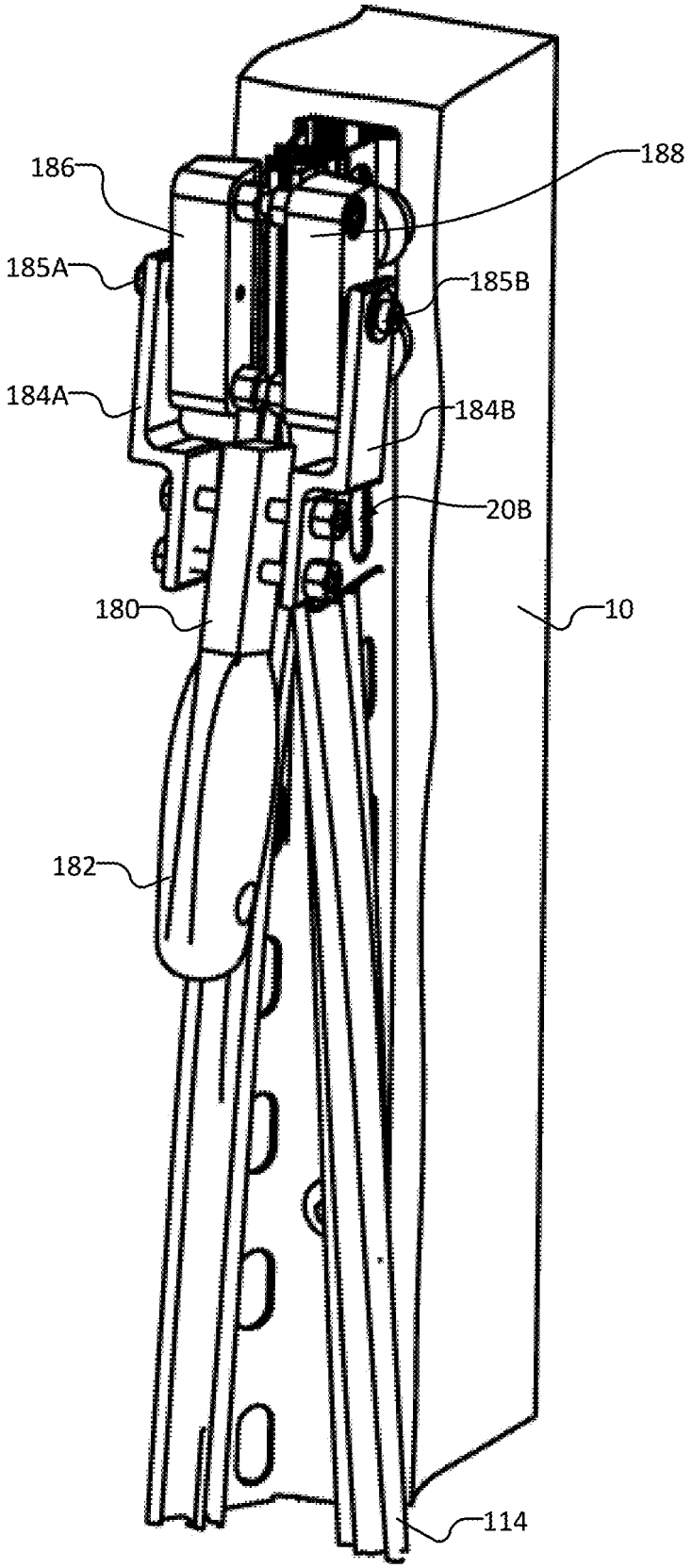
FIG. 14A depicts an elevated perspective view of a tool being employed to close a standoff of the formwork apparatus for repairing existing structures of FIG. 2.
Figure 14B:
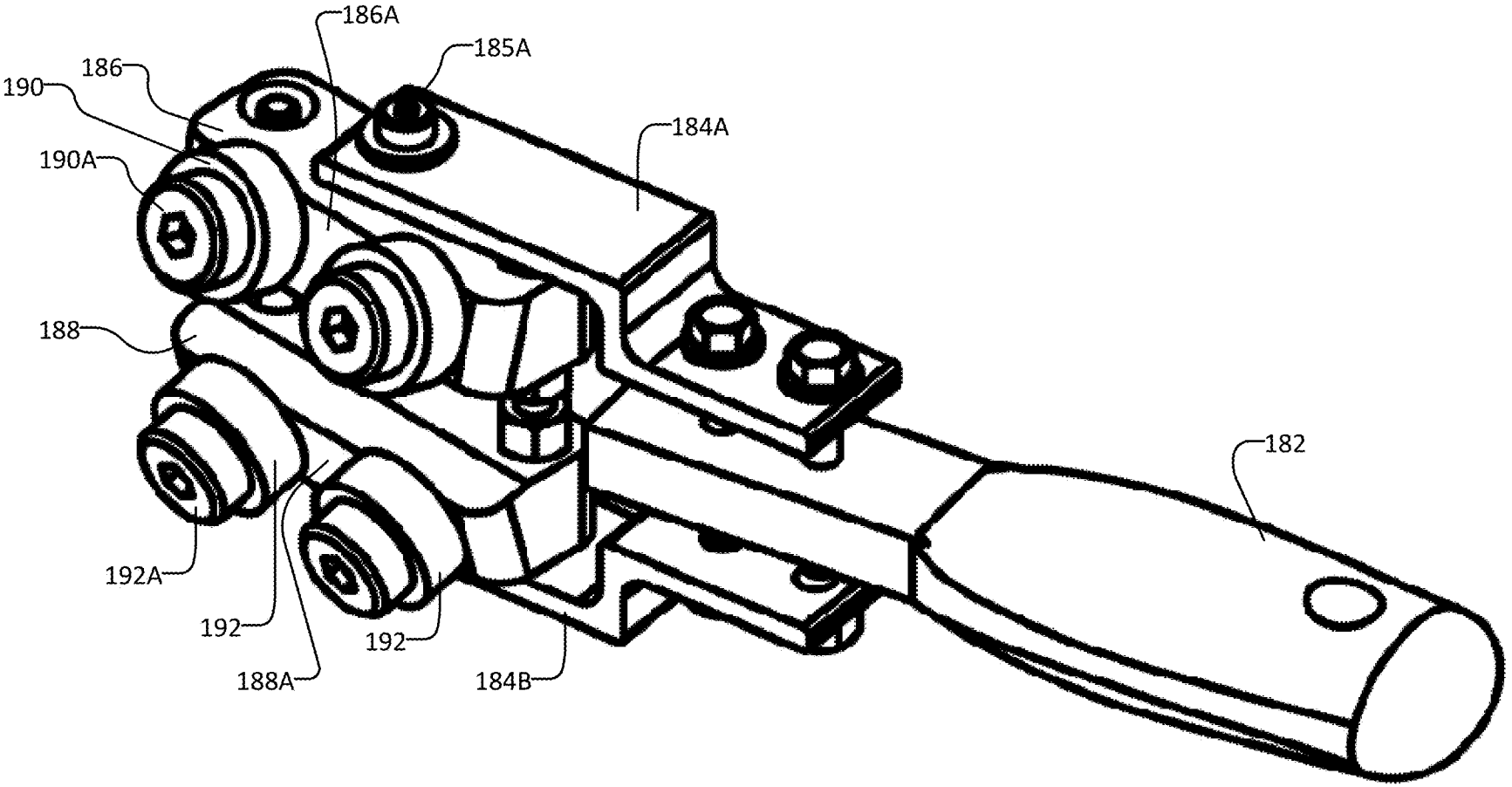
FIG. 14B depicts a perspective view of the tool of FIG. 14A.

Standoff 114 may be closed (e.g. connection 137 may be formed) by applying force manually to first and second arms 132, 134 or force may be applied to first and second arms 132, 134 using any suitable technique or apparatus. FIGS. 14A and 14B depict a tool 180 for closing standoffs 114 (or standoffs 214, 314, 414, etc.).

Tool 180 comprises a handle 182 which is connected to arms 184A, 184B. Arms 184A, 184B are in turn connected to tool heads 186, 188 respectively. In some embodiments, tool head 186 is pivotally connected to arm 184A by a pivot joint 185A and tool head 188 is pivotally connected to arm 184B by a pivot joint 185B. Tool head 186 has a tool face 186A and tool head 188 has a tool face 188A. One or more rollers 190 are rotatably connected to tool face 186A and one or more rollers 192 are rotatably connected to fool face 188A. For example, in the illustrated embodiment two rollers 190 are rotatably connected to tool face 186A and two rollers 192 are rotatably connected to tool face 188A. Rollers 190, 192 may be attached to tool faces by one or more fasteners 190A, 192A respectively and rollers 190, 192 may be rotatably mounted to fasteners 190A, 192A in any suitable way such as by means of a bearing, bushing or the like.

Rollers 190, 192 may be shaped and/or dimensioned to be able to exert a force (e.g. to form a complementary fit with or to otherwise engage) exterior surfaces 132C, 134C of first and second arms 132, 134 of standoff 114. Such force may be sufficient to form connection 137 when rollers 190, 192 engage exterior surfaces 132C, 134C. For example, first and second arms 132, 134 may comprise guides 132D, 134D respectively for engaging rollers 190, 192 and when tool 180 engages standoff 114, rollers 190, 192 protrude into spaces between guides 132D, 134D and are guided by guides 132D, 134D on exterior surfaces 132C, 134C of standoffs 114.

Tool 180 may be employed to form connection 137 by carrying out the following steps: (1) move first and second arms 132, 134 into proximity with one another such that first arm connector component 136 is adjacent to and aligned with second arm connector component 138 (as depicted, for example, in FIG. 7C); (2) close standoff 114 along a first longitudinal direction 119 portion of standoff 114, as shown in FIG. 14A; (3) position tool 180 such that each of rollers 190, 192 engages a portion of exterior surfaces 132C, 134C of first and second arms 132, 134 respectively (e.g. the portions of exterior surfaces 132C, 134C between guides 132D, 134D); (4) move tool 180 in longitudinal direction 119 toward a remaining open portion of standoff 114 such that rollers 190, 192 roll along exterior surfaces 132C, 143C of first and second arms 132, 134 and tool 180 acts as a "zipper" to close standoff 114 (e.g. to form connection 137).

Pivot joints 185A, 185B allow tool heads 186, 188 to be rotated relative to arms 184A, 184B about pivot axes (not expressly enumerated) that are co-axial with pivot joints 185A, 185B. In this way, pivot joints 185A, 185B may aid in allowing a user to slide tool 180 along longitudinal direction 119 of standoff 114 since pivot joints 185A, 185B allow a user to better grip handle 182—e.g. when handle 182 is above the user's shoulders or below the user's waist.

Tool 180 is not restricted to being used with standoffs 114 discussed therewith but may be used with other types of standoffs described herein.

Figure 15:
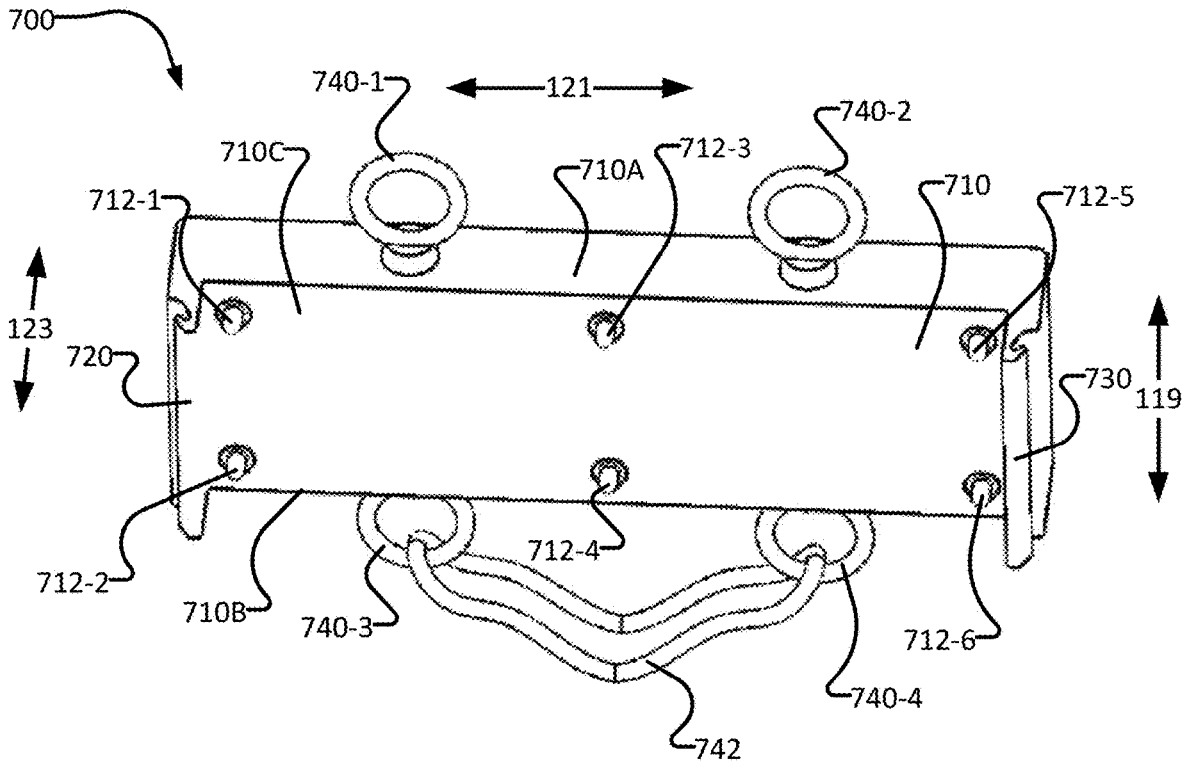
FIG. 15 is an elevated perspective view of a tool being employed to attach a first panel to standoffs of the formwork apparatus for repairing existing structures of FIG. 2.
Figure 17:
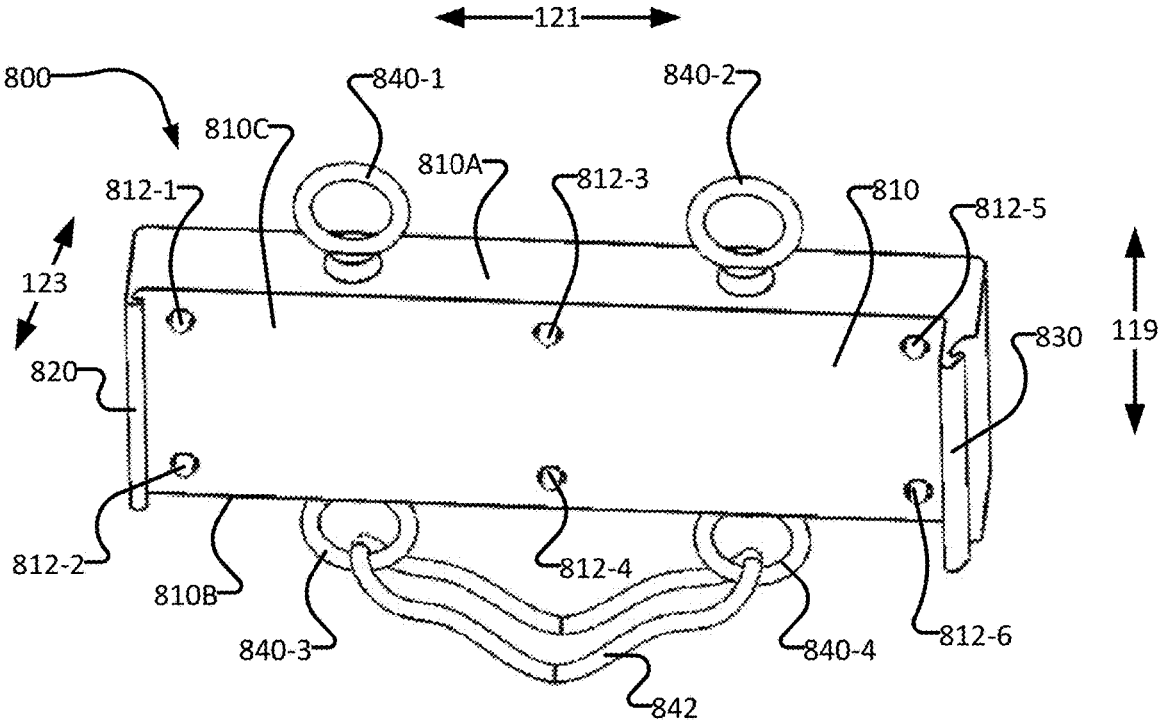
FIG. 17 is an elevated perspective view of a tool being employed to attach a second panel to standoffs of the formwork apparatus for repairing existing structures of FIG. 2.

Panels 116 may be attached to standoffs 114 (or standoffs 214, 314, 414, etc.) by applying force manually in inward-outward direction 123 toward existing structure 10 or force may be applied to panels 116 using any suitable technique or apparatus. FIG. 15 depicts a first panel tool 700. FIG. 17 depicts a second panel tool 800. First panel tool 700 is substantially similar to second panel tool 800 except in that first panel tool 700 is configured to attach a first panel 116-1 to standoffs 114 (or standoffs 214, 314, 414, etc.) and second panel tool 800 is configured to attach a second panel 116-2 to standoffs 114 (or standoffs 214, 314, 414, etc.), adjacent to first panel 116-1 after first panel 116-1 has already been installed on standoffs 114 (or standoffs 214, 314, 414, etc.), as discussed further below.

First panel tool 700 comprises a panel tool body 710 extending in longitudinal direction 119 and transverse direction 121. First and second panel tool connectors 720, 730 extend from transversely spaced apart ends of panel tool body 710 in inward-outward direction 123. A plurality of set pins 712-1, 712-2, 712-3, 712-4, 712-5, 712-6 (collectively or generically referred to as set pins 712) extend from surface 710C of panel tool body 710 in inward-outward direction 123. For example, in the illustrated embodiment, first and second set pins 712-1, 712-2 are oriented along a longitudinal direction 119 axis generally adjacent to first panel tool connector 720, third and fourth set pins 712-3, 712-4 are oriented along a longitudinal direction 119 axis generally equidistantly spaced apart in transverse direction 121 from first panel tool connector 720 and second panel tool connector 730 and fifth and sixth set pins 712-5, 712-6 are oriented along a longitudinal direction 119 axis generally adjacent to second panel tool connector 730. One or more handle features 740-1, 740-2, 740-3, 740-4 (collectively or generically referred to as handle features 740) may extend from one or both transversely extending edges 710A, 710B of panel tool body 710. For example, in the illustrated embodiment, first and second handle features 740-1, 740-2 extend from transversely extending edge 710A of panel tool body 710 and third and fourth handle features 740-3, 740-3 extend from transversely extending edge 710B of panel tool body 710.

First panel tool connector 720 may be complementary to one of first and second standoff connector components 122A, 122B while second panel tool connector 730 may be complementary to the other of first and second standoff connector components 122A, 122B.

In some embodiments, each of set pins 712 may be threaded into panel tool body 710 such that the amount that each of set pins 712 extends or protrudes from surface 710C of panel tool body 710 may be adjusted by threading a set pin 712 in or out. While the first panel tool 700 is depicted as comprising six set pins, this is not mandatory and any suitable number of set pins may be employed. Further, set pins 712 may be replaced with ridges, nubs or the like. Further still, surface 710C itself may serve the same function as set pins 712 instead of set pins 712.

In the illustrated embodiment, handle features 740 comprise loops for attaching handle 742. This is not mandatory. Handle features 740 may comprise any suitable feature to serve as a handle or to serve for attaching a handle such as handle 742. While handle features 740 are depicted on both edges 710A, 710B, this is not mandatory and in some embodiments, only one of edges 710A, 710B may comprise handle features 740.

Figure 16A:
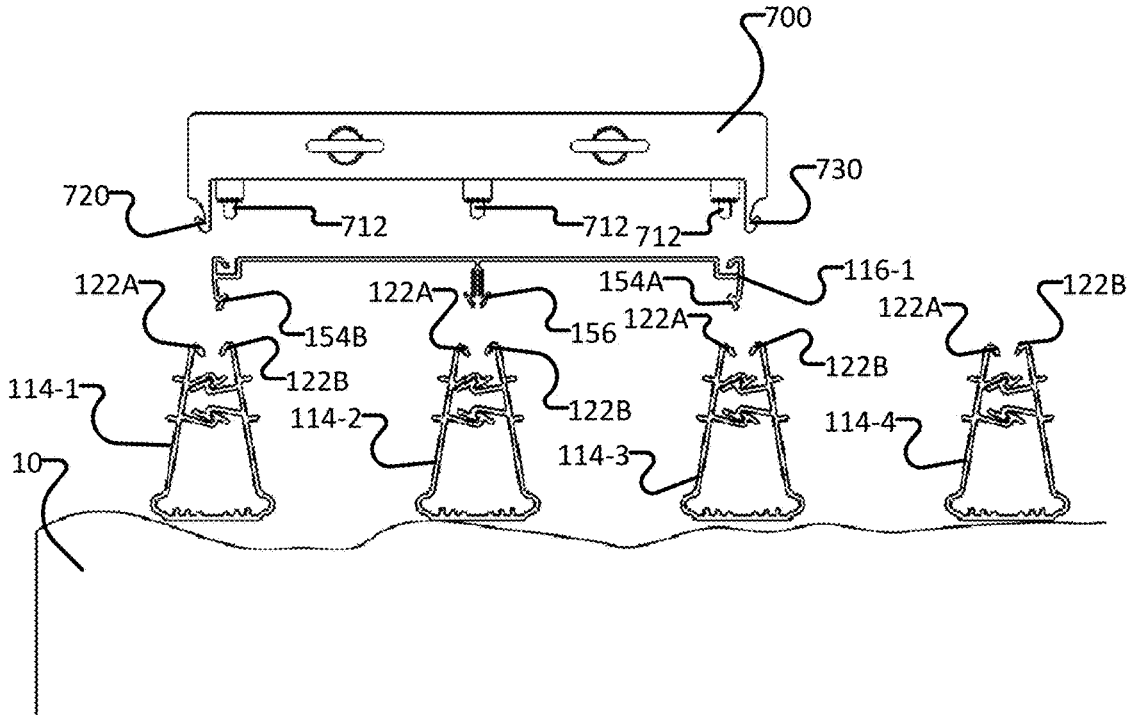
FIGS. 16A to 16C are top views of the tool of FIG. 15 being employed to attach a first panel to standoffs of the formwork apparatus for repairing existing structures of FIG. 2.

In practice, first panel 116-1 is aligned with first, second and third standoffs 114-1, 114-2, 114-3 as shown in FIG. 16A and as described in relation to FIGS. 9A to 9J. At the same time, or subsequently, first panel tool 700 is aligned with first panel 116-1 such that first and second set pins 712-1, 712-2 and fifth and sixth set pins 712-5, 712-6 align with connector components 154 while third and fourth set pins 712-3, 712-4 align with connector component 156.

Figure 16B:
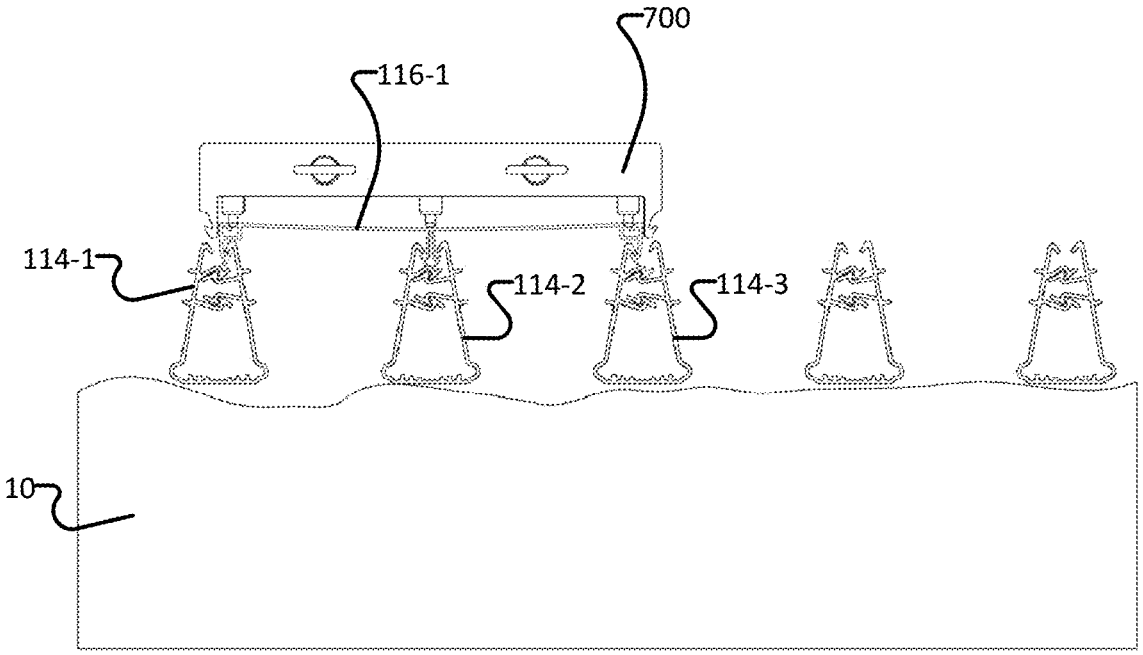

A first longitudinal portion of first panel 116-1 (and not the entire longitudinal length of panel 116-1) may be connected by manually forcing connector components 154, 156 into connection with first, second and third standoffs 114-1, 114-2, 114-3 in the same manner as described in relation to FIGS. 9A to 9J or first panel tool 700 may be forced in inward-outward direction 123 toward existing structure 10 to thereby force connector components 154, 156 into connection with first, second and third standoffs 114-1, 114-2, 114-3 in the same manner as described in relation to FIGS. 9A to 9J as shown in FIG. 16B.

Figure 16C:
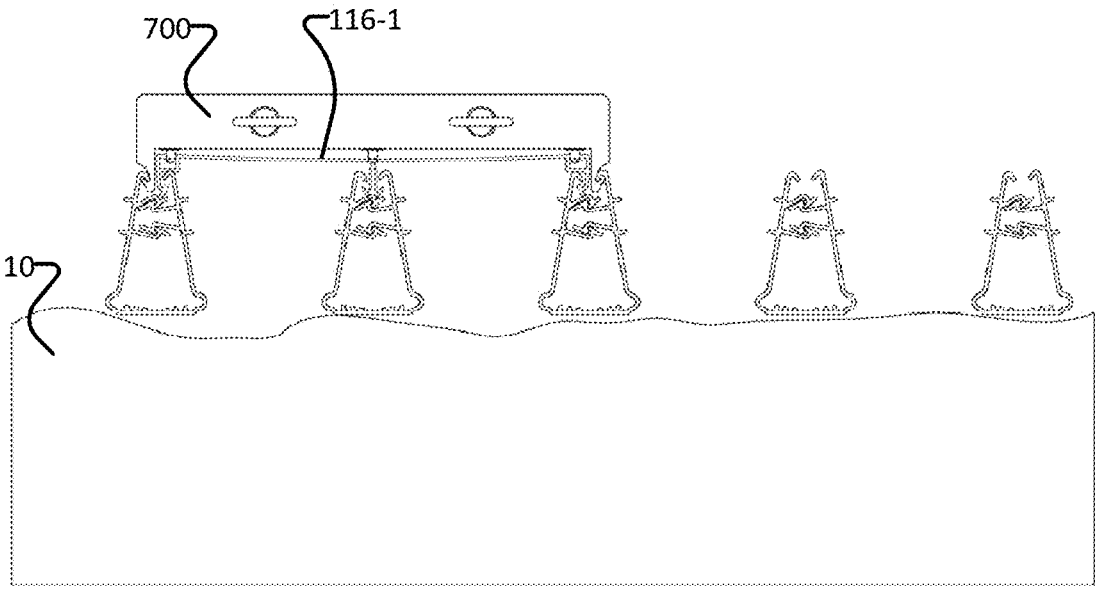
Figure 16D:
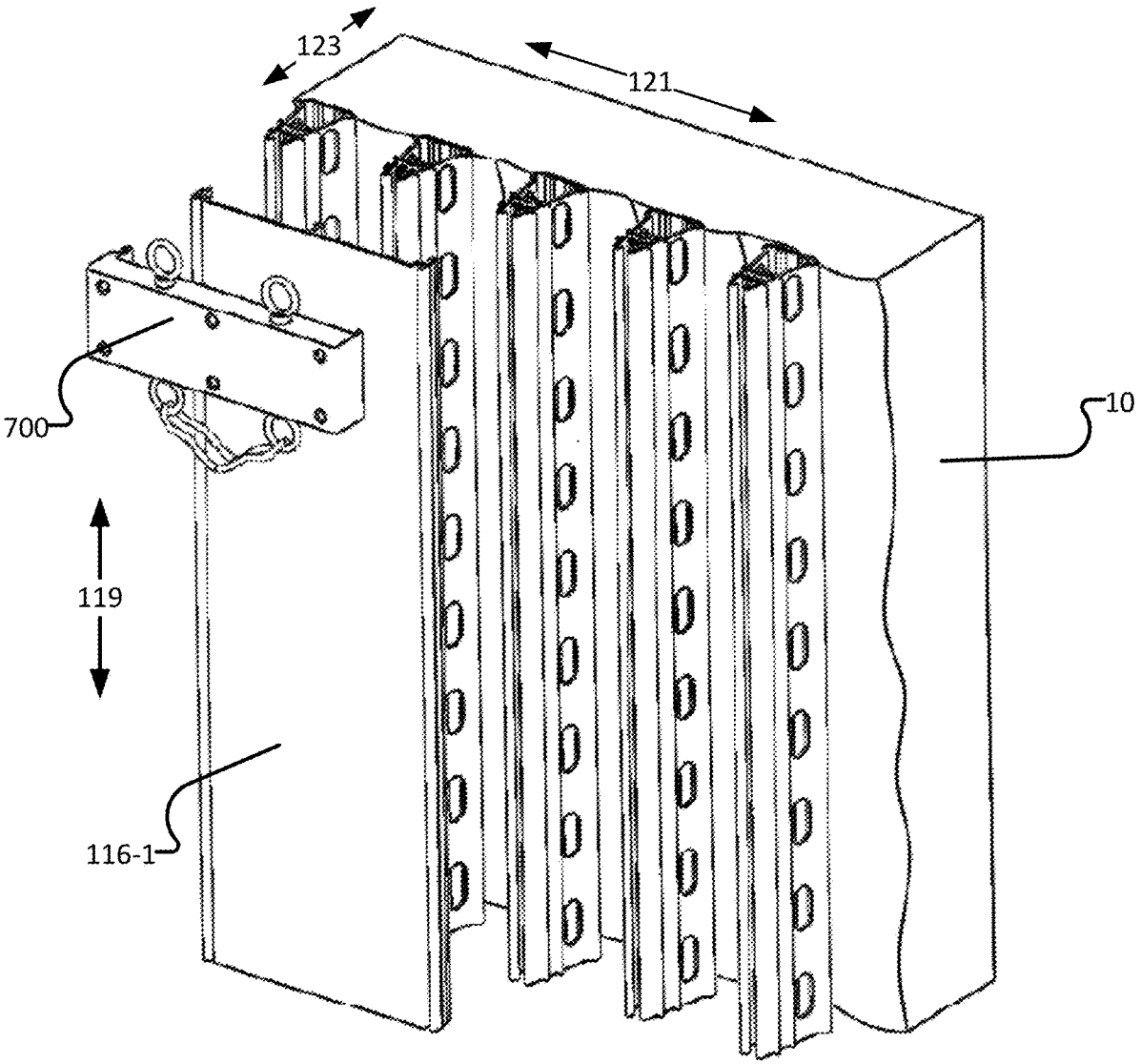
FIG. 16D is an elevated perspective view of the tool of FIG. 15 being employed to attach a first panel to standoffs of the formwork apparatus for repairing existing structures of FIG. 2.

As first panel tool 700 continues to move in inward-outward direction 123 toward existing structure 10, first and second panel tool connectors 720, 730 connect to first and second standoff connector components 122A, 122B of first and third standoffs 114-1, 114-3 as shown in FIG. 16C to thereby connect first panel tool 700 to first and third standoffs 114-1, 114-3. First and second panel tool connectors 720, 730 may connect to first and second standoff connector components 122A, 122B in substantially the same manner that panel connector components 154A, 154B connect to first and second standoff connector components 122A, 122B.

When first panel tool 700 is connected to first and third standoffs 114-1, 114-3, set pins 112 may apply force to panel 116-1 urging panel 116-1 toward existing structure 10 and into connection with first, second and third standoffs 114-1, 114-2, 114-3. By sliding (pulling or pushing) first panel tool 700 in longitudinal direction 119 away from the first longitudinal portion of first panel 116-1 that is connected to standoffs 114 and toward a second remaining portion of first panel 116-1 that is not connected to standoffs 114, the second remaining portion of first panel 116-1 may be connected to standoffs 114. In particular, as first panel tool 700 is pulled (or pushed), first and second panel tool connectors 720, 730 slide in first and second standoff connector components 122A, 122B in longitudinal direction 119 and set pins 112 apply force on unconnected portions of first panel 116-1 as they move longitudinally along panel 116-1 to urge each unconnected portion of panel 116-1 toward existing structure 10 and into connection with first, second and third standoffs 114-1, 114-2, 114-3. This may be continued until the entire longitudinal length of first panel 116-1 is connected to first, second and third standoffs 114-1, 114-2, 114-3. First panel tool 700 may then be removed from contact with first panel 116-1 by, for example, sliding it longitudinally off of first panel 116-1.

Once first panel 116-1 is connected to first, second and third standoffs 114-1, 114-2, 114-3, it may be desirable to connect a second panel 116-2 to third, fourth and fifth standoffs 11-4-3, 114-4, 114-5. Since first panel 116-1 would interfere with first panel tool connector 720 of first panel tool 700, second panel tool 800 may be employed instead to connect second panel 116-1 to existing structure 10.

Second tool panel 800 is substantially similar to first panel tool 700 except as follows. Second panel tool 800 comprises a panel tool body 810 extending in longitudinal direction 119 and transverse direction 121. First and second panel tool connectors 820, 830 extend from panel tool body 810 in inward-outward direction 123. A plurality of set pins 812-1, 812-2, 812-3, 812-4, 812-5, 812-6 (collectively or generically referred to as set pins 812) extend from panel tool body 810 in inward-outward direction 123. For example, in the illustrated embodiment, first and second set pins 812-1, 812-2 are oriented along a longitudinal direction 119 axis generally adjacent to first connector 820, third and fourth set pins 812-3, 812-4 are oriented along a longitudinal direction 119 axis generally equidistantly spaced apart in transverse direction 121 from first connector 820 and second connector 830 and fifth and sixth set pins 812-5, 812-6 are oriented along a longitudinal direction 119 axis generally adjacent to second connector 830. One or more handle features 840-1, 840-2, 840-3, 840-4 (collectively or generically referred to as coupling features 840) may extend from one or both transversely extending edges 810A, 810B of panel tool body 810. For example, in the illustrated embodiment, first and second handle features 840-1, 840-2 extend from transversely extending edge 810A of panel tool body 810 and third and fourth handle features 840-3, 840-3 extend from transversely extending edge 810B of panel tool body 810.

Figures 9A, 9B, 9C, 9D, 9E, 9F, 9G, 9H, 9I, 9J:
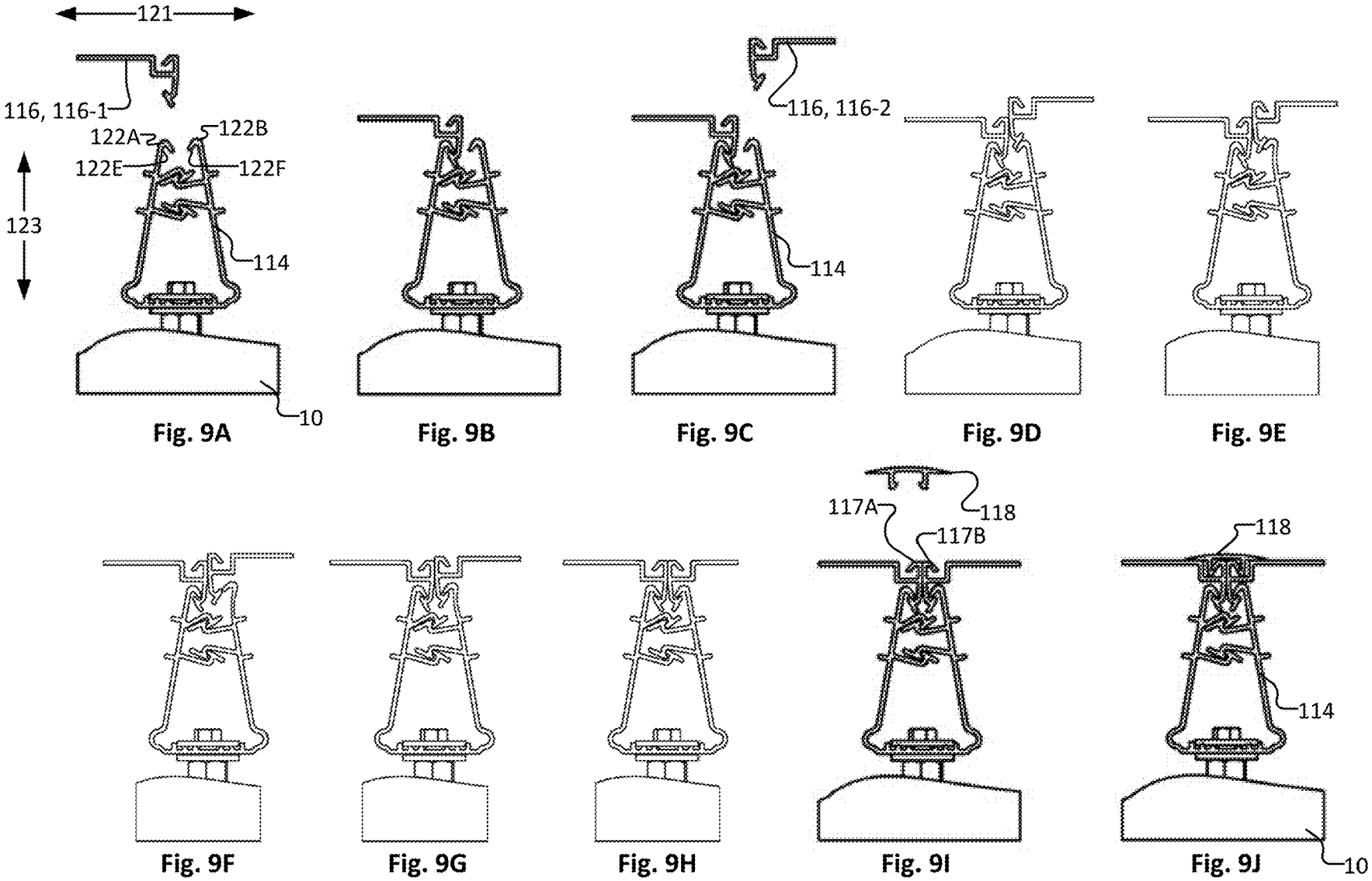
FIGS. 9A to 9J depict magnified views of a portion the formwork apparatus for repairing existing structures of FIG. 2.
Figure 18A:
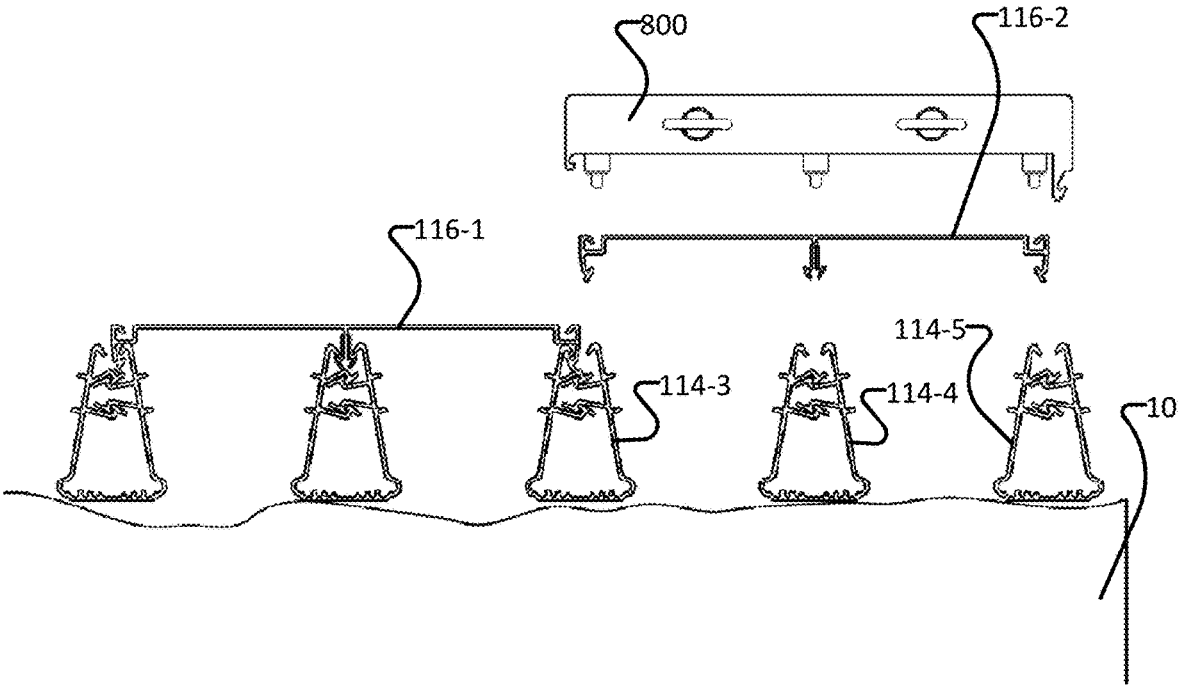
FIGS. 18A to 18C are top views of the tool of FIG. 17 being employed to attach a second panel to standoffs of the formwork apparatus for repairing existing structures of FIG. 2.
Figure 18B:
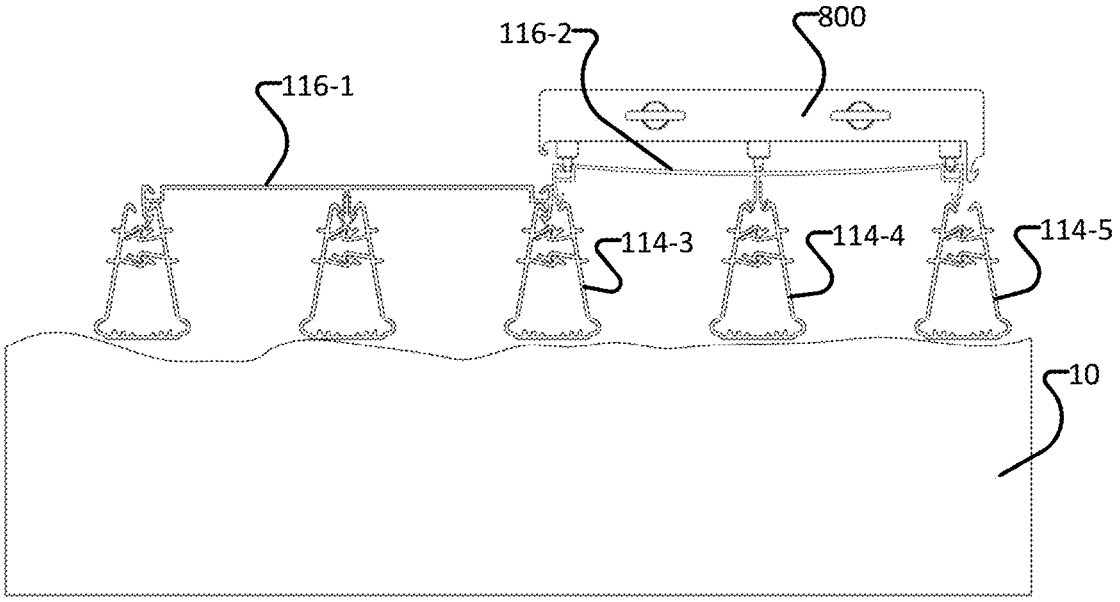
Figure 18C:
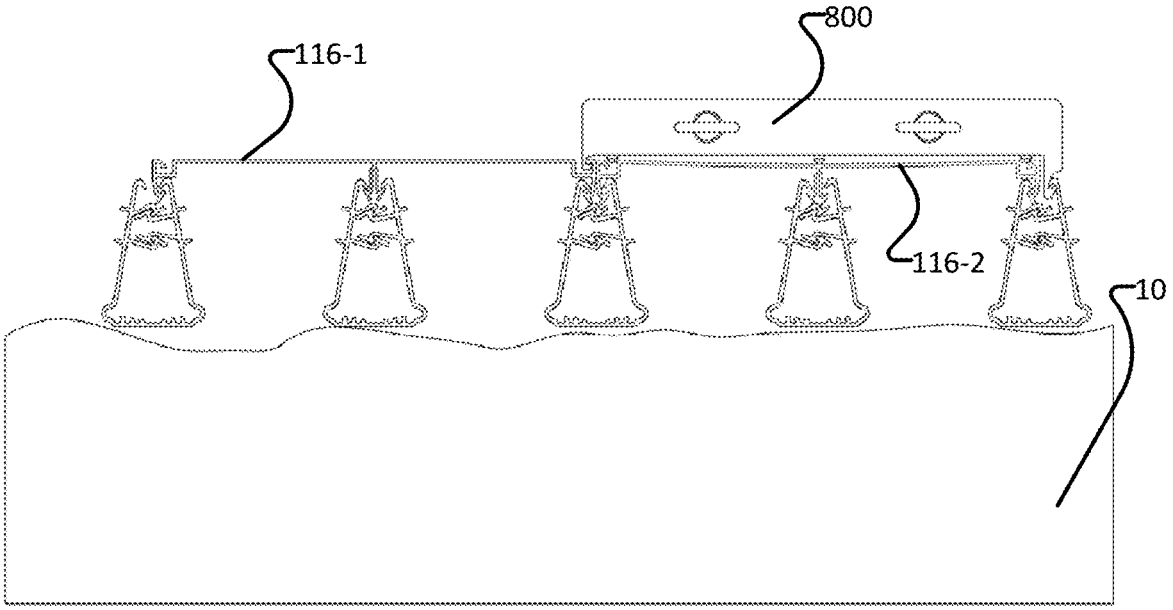
Figures 19A, 19B, 19C, 19D:
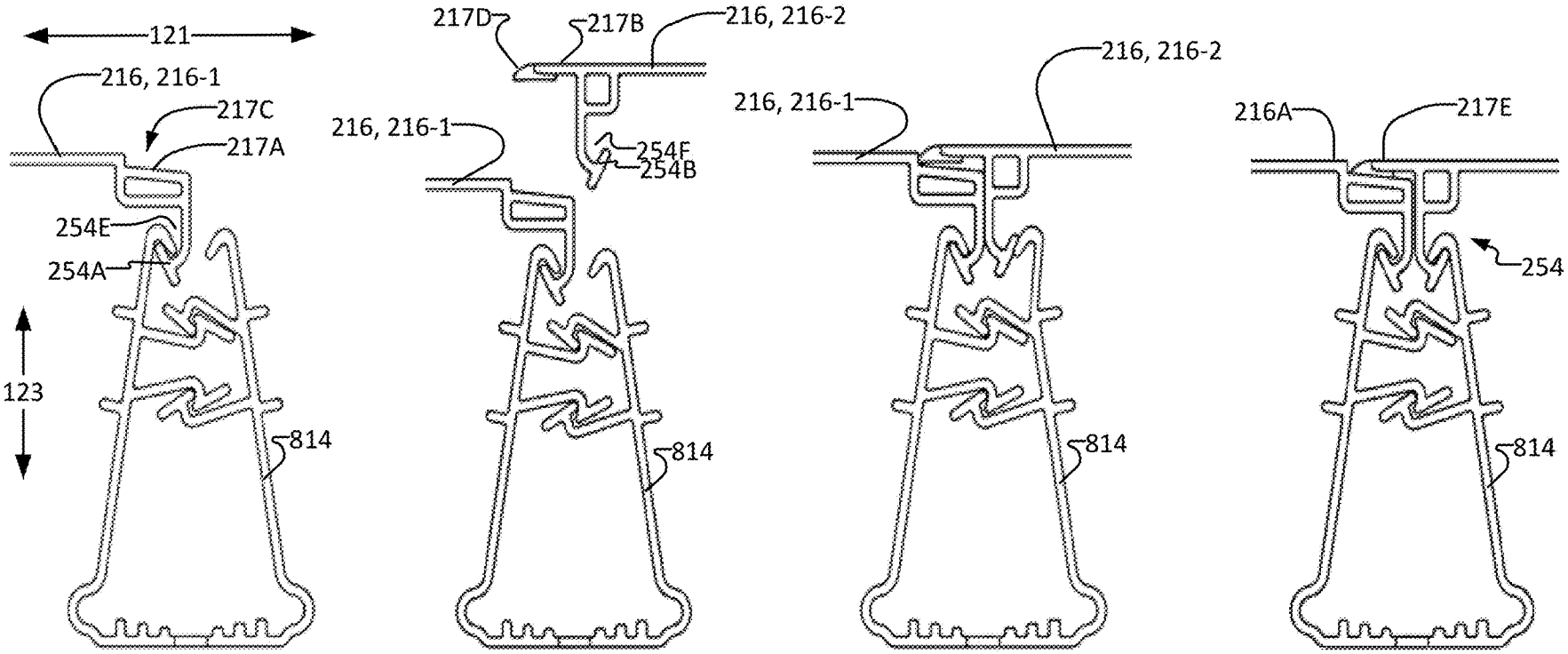
FIGS. 19A to 19D depict magnified views of a portion a formwork apparatus for repairing existing structures.
Figure 20A:
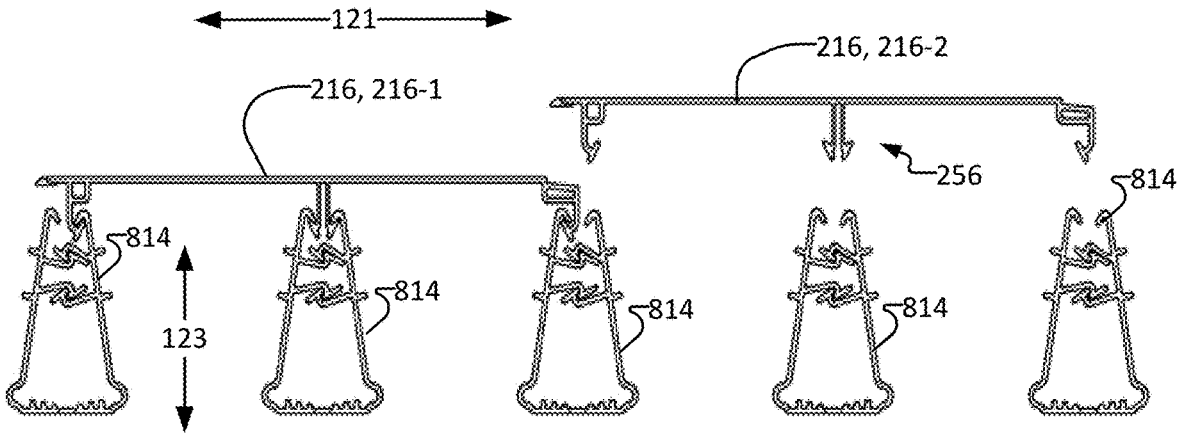
FIGS. 20A to 20C are top views of the formwork apparatus for repairing existing structures of FIGS. 19A to 19D.
Figure 20B:
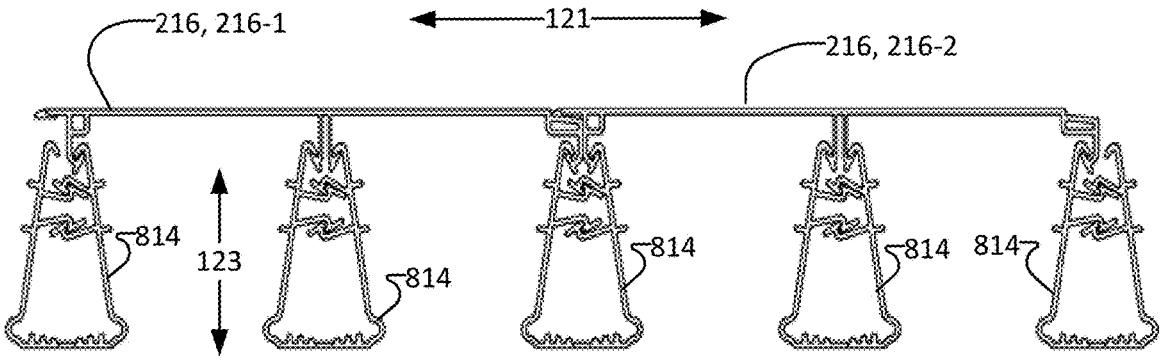
Figure 20C:
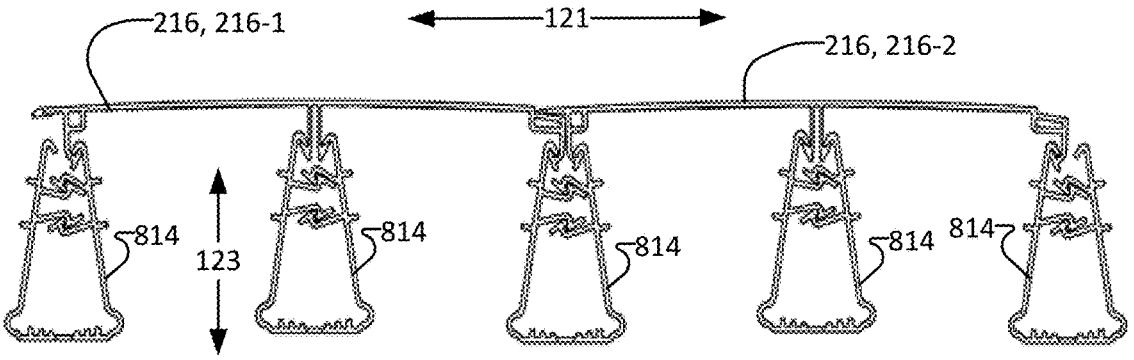

First panel tool connector 820 may be complementary to one of first and second cap connector components 117A, 117B (as shown in FIG. 9I) of first panel 116-1 while second panel tool connector 830 may be complementary to one of first and second standoff connector components 122A, 122B of second panel 116-2 as shown in FIGS. 18A to 18C. In this way, first panel 116-1 does not interfere with first panel tool connector 820.

Second panel tool 800 may be employed in substantially the same way as first panel tool 700 except in that first panel tool connector 820 may slide along one of first and second cap connector components 117A, 117B of first panel 116-1 while second panel tool connector 830 slides along one of first and second standoff connector components 122A, 122B of second panel 116-2 to thereby connect second panel 116-2 to existing structure 10. Subsequent panels may also be connected to existing structure 10 by employing second panel tool 800.

FIGS. 19A to 19B and 20A to 20C illustrate a panel 216 and a standoff 814 according to another embodiment. Standoff 814 may be substantially similar to any of the standoffs described herein such as standoffs 114, 214, 314, 414, 514, 614. Panel 216 may be substantially similar to panel 116 except as described below. For example, panel 216 may comprise connector components 254, 256 similar to connector components 154, 156 (e.g. connector components 254 have hooked branches 254A, 254B and concavities 254E, 254F like hooked branches 154A, 154B and concavities 154E, 154F and connector components 256 have hooked branches 256A, 256B and concavities 256E, 256F like hooked branches 156A, 156B and concavities 156E, 156F). In this way, panels 216 may be connected to standoffs 814 in a substantially similar manner to panels 116 and standoffs 114, 214, 314, 414, 514, 614 described herein.

Panels 216 differ from panels 116 in that first and second cap connector components 117A, 117B and cap 118 are substituted with recessed portion 217A and integrated cover 217B. As can be seen from FIGS. 19A to 19C and 20A to 20C, after hooked arm 254A and concavity 254E of first panel 216-1 are connected to standoff 814, hooked arm 254B and concavity 254F of second panel 216-1 may also be connected to standoff 814. As second panel 216-2 moves in inward-outward direction 123 toward standoff 814, integrated cover 217B extends into recess 217C defined by recessed portion 217A. Recess 217C may be complementary in shape to integrated cover 217B. Recess 217C may be sized such that when integrated cover 217B is received in recess 217C, an outer surface 217E of integrated cover 217B is flush or substantially flush with an outer surface 216A of panel 216-1. When the connection is made between connector components 254 and standoff 814, integrated cover 217B may contact recessed portion 217A to create a seal between first and second panels 216-1, 216-2 to prevent or hinder dirt, liquid, gas, dust or the like from penetrating between edge adjacent panels 216-1, 216-2. In some embodiments, a seal 217D is attached to recessed portion 217A or integrated cover 217B to provide an improved seal between edge adjacent panels 216-1, 216-2. Seal 217D may comprise any suitable material. Seal 217D may be coextruded with panels 216. Seal 217D may be added (e.g. bonded) to panel 216 after fabrication of panel 216 or after installation of panel 216.

Integrated cover 217B may be shaped such that when the connection is made between connector components 254 and standoff 814, integrated cover 217B of panel 216-2 overlaps at least a portion (e.g. recessed portion 217A) of panel 216-1 in inward-outward direction 123. Such overlap may further improve the seal between edge adjacent panels 216-1, 216-2.

In some embodiments, integrated cover 217B and/or seal 217D are deformed during formation of the connection between connector component 254 and standoff 814, resulting in the creating of restorative deformation forces. Integrated cover 217B and/or seal 217D are shaped such that the restorative deformation forces associated with the deformation of integrated cover 217B and/or seal 217D are maintained after the formation of the connection between connector component 254 and standoff 814—i.e. after the formation of the connection between connector components 254 and standoff 814, integrated cover 217B and/or seal 217D are not restored all the way to their original non-deformed shapes, resulting in the existence of restorative deformation forces after the formation of the connection between connector component 254 and standoff 814. Such restorative deformation forces may tend to cause integrated cover 217B and/or seal 217D to contact, maintain contact with, or be forced against recessed portion 217A to further improve the seal between edge adjacent panels 216-1, 216-2.

In some embodiments, recessed portion 217A may be sloped in inward-outward direction 123 toward standoff 814 such that if standoffs 814 and panels 216 are installed on a convex surface (see, for example, FIG. 20C), recessed portion 217A and integrated cover 217B may remain flush and in contact to maintain a seal between first and second panels 216-1, 216-2.

Figure 21A:
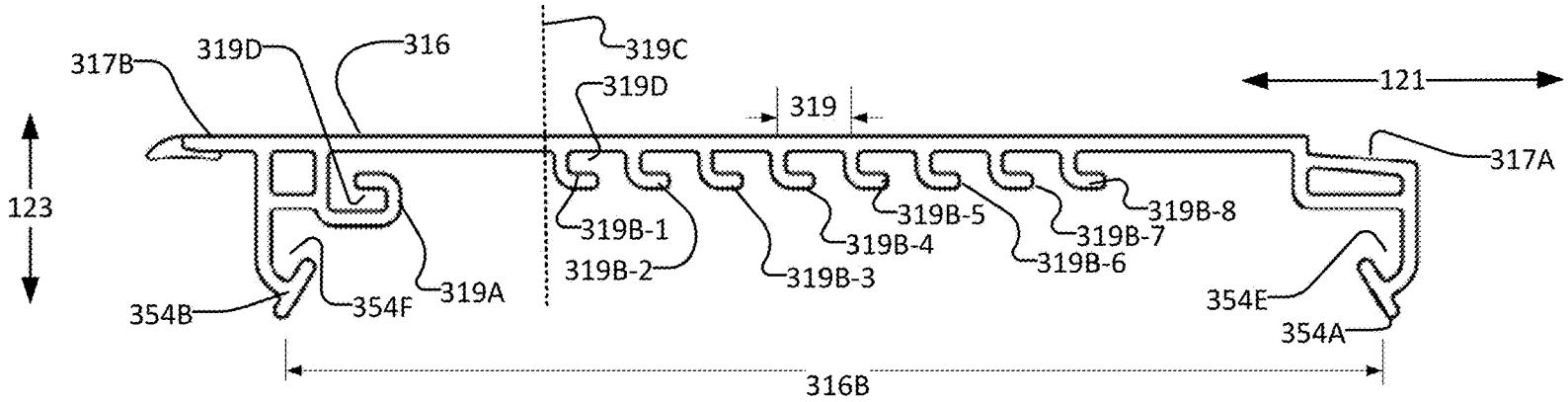
FIGS. 21A and 21B are top views of panels for a formwork apparatus for repairing existing structures.
Figure 21B:
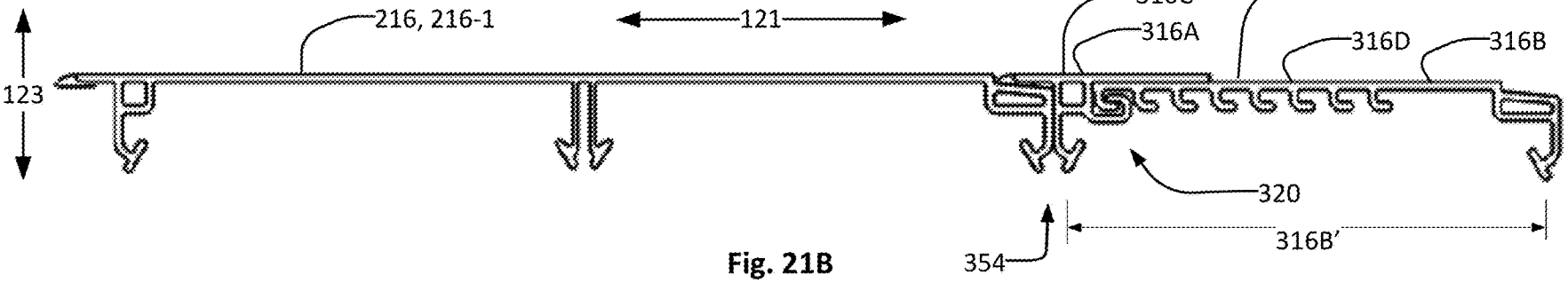

FIGS. 21A and 21B illustrate a panel 316 according to another embodiment. Panel 316 may be substantially similar to panel 216 except as described below. For example, panel 316 may comprise connector components 354 similar to connector components 254 (e.g. connector components 354 have hooked branches 354A, 354B and concavities 354E, 354F like hooked branches 254A, 254B and concavities 254E, 254F. Panels 316 comprise recessed portion 317A and integrated cover 317B similar to recessed portion 217A and integrated cover 217B similar to panels 216. In this way, panels 316 may be connected to standoffs 114, 214, 314, 414, 514, 614, 814 in a substantially similar manner to panels 116, 216 and standoffs 114, 214, 314, 414, 514, 614, 814 described herein.

Panels 316 differ from panels 216 in that panels 316 do not necessarily comprise connector components 256 (although panels 316 could include connector components 256, if desired) and, panels 316 include connector 319A and connectors 319B-1, 319B-2, 319B-3, 319B-4, 319B-5, 319B-6, 319B-7, 319B-8 (collectively or generically referred to as connectors 319B) to allow a transverse direction 121 dimension of panels 316 to be adjusted such that a spacing 316A between hooked branch 354A and hooked branch 354B can be adjusted as desired. While panel 316 is depicted as having eight connectors 319B, this is not necessary and panel 316 may have one, two, three or more connectors 319B, as desired.

Transverse direction 121 dimension and spacing 316A of a panel 316 may be adjusted by first cutting panel 316 along cut line 319C (e.g., using a sharp edged tool, heat, a combination thereof, or the like). While cut line 319C is depicted as being adjacent connector 319B-1, this is not mandatory and cut line 319C may be located adjacent any one of connectors 319B such that cutting panel 316 along cut line 319C forms a first portion 316A of panel 316 and a second portion 316B of panel 316 where first portion 316A comprises connector 319A and second portion 316B comprises at least one of connectors 319B. In some embodiments, panel 316 may comprise portions of reduced thickness (e.g., longitudinal grooves) along cut line 319C to facilitate cutting of panel 316. In the illustrated embodiment, since first portion 316A does not comprise any connectors 319B, no additional cuts are required. However, in the case that cut line 319C is located between, for example, connector 319B-1 and connector 319B-2, an additional cut may be employed to remove connector 319B-1 from first portion 316A such that connector 319B-1 would not interfere with the formation of connection 320 between first and second portions 316A, 316B.

After first and second portions 316A, 316B are formed, connection 320 between first and second portions 316A, 316B may be formed by connecting connector 319A of first portion 316A to a remaining connector 319B of second portion 316B. When connection 320 is formed between connector 319A and a connector 319B, the interaction of connector 319A and connector 319B prevents or inhibits movement of first and second portions 316A, 316B relative to one another in one or more of transverse direction 121, inward-outward direction 123 and longitudinal direction 119. When connection 320 is formed, a panel 316' is formed having a transverse direction 121 dimension and spacing 316B' that is smaller than the transverse direction 121 dimension and spacing 316B of panel 316. This adjustability of the transverse direction 121 dimension and spacing 316B of panel 316 may be desirable for applications where a standard size of panel 216 (or 116) does not fit and/or where it is undesirable to manufacture custom sized panels. This adjustability of the transverse direction 121 dimension and spacing 316B of panel 316 may also be desirable where regular or consistent transverse direction 121 spacing between standoffs (e.g. standoffs 114, 214, 314, 414, 514, 614, 814) is not practical, possible or desired.

Connectors 319A, 319B may be any suitable type of connectors. Connectors 319A, 319B may extend longitudinally along an inward face of panel 316. For example, in the illustrated embodiments, connector 319A is shaped to define a channel 319D that is in turn shaped to receive one of connectors 319B and each connector 319B is shaped to define a channel 319E that is in turn shaped to receive connector 319A. In some embodiments, one of connectors 319B is slid into channel 319D in longitudinal direction 119 (e.g. into the page in FIG. 21A) to form connection 320 while in other embodiments, connection 320 between connector 319A and a connector 319B is formed by pushing connector 319A and a connector 319B toward one another in transverse direction 121 and/or inward-outward direction 123 or by pivoting or rotating a connector 319B into connector 319A or in any other suitable manner. In some embodiments, one or both of connectors 319A, 319B may undergo deformation during the formation of connection 320 and, due to restorative deformation forces, may restore to its undeformed state or may restore partially toward its undeformed state when connection 320 is made. Such restorative deformation may serve to further lock connection 320 and reduce relative movement between connectors 319A, 319B of connection 320.

Adjacent connectors 319B are spaced apart from each other in transverse direction 121 by a spacing 319D. In some embodiments, spacing 319D between adjacent connectors 319B is consistent (e.g. spacing 319D between connectors 319B-1, 319B-2 is equal to spacing 319D between connectors 319B-2, 319B-3 and connectors 319B-3, 319B-4 etc.). This is not mandatory. In some embodiments, spacing 319D between adjacent connectors may be different for different pairs of adjacent connectors such that, for example, spacing 319D between connectors 319B-1, 319B-2 is not equal to spacing 319D between connectors 319B-2, 319B-3 and/or connectors 319B-3, 319B-4 etc. Such unequal spacing 319D may allow for employing panel 316 or combinations of panels 316 to achieve a greater variety of transverse direction 121 dimensions and spacing 316A', as desired.

When connection 320 is formed between first portion 316A and second portion 316B, an outer surface 316C of first portion 316A may not align in inward-outward direction 123 with an outer surface 316D of second portion 316B as shown in FIG. 21B. In some embodiments, to prevent the ingress of water, dust, dirt etc. between outer surface 316D and first portion 316A, a sealant may be installed between outer surface 316D and first portion 316A. In some embodiments, to reinforce connection 320 and/or prevent relative movement between first and second portion 316A, 316B, an additional fastener such as a screw, nut and bolt or the like may be installed through outer surface 316C of first portion 316A and in turn through outer surface 316D of second portion 316B.

After panel 316' is formed (e.g. when connection 320 is made), panel 316' may be connected to one or more standoffs (e.g. standoffs 114, 214, 314, 414, 514, 614, 814) along with another panel in substantially the same manner as with other panels 116, 216 discussed herein. For example, FIG. 21B shows a first panel 216-1 and a second panel 316-2 ready to be connected to one or more standoffs (e.g. standoffs 114, 214, 314, 414, 514, 614, 814).

As will be apparent to those skilled in the art in the light of the foregoing disclosure, many alterations and modifications are possible in the practice of this invention without departing from the spirit or scope thereof. For example:

Methods and apparatus described herein are disclosed to involve the use of concrete to repair various structures. It should be understood by those skilled in the art that in other embodiments, other curable materials could be used in addition to or as an alternative to concrete. By way of non-limiting example, formwork 110 could be used to contain a structural curable material similar to concrete or some other curable material (e.g. curable foam insulation, curable protective material or the like), which may be introduced into void 170 between panels 116 and existing structure 10 when the material was in liquid form and then allowed to cure to provide repair structure and to thereby repair existing structure 10.

The longitudinal dimensions 119 of standoffs 114, panels 116 and optional cap connectors 120 may be fabricated to have desired lengths or may be cut to desired lengths. Panels 116 may be fabricated to be have modularly dimensioned transverse width dimensions 121 (e.g. 1, 2, 4, 6, 8, 12 and 16 inches) to fit various existing structures 10 and for use in various applications. Similarly, the inward-outward dimension of standoffs 114 may be sized as desired for particular applications.

In the illustrated embodiment, panels 116 comprise a single interior connector component 156 which is connected to a corresponding single standoff 114. In other embodiments, panels 116 may comprise a different number of interior connector components 156 and may connect to a different number of standoffs 114. For example, in cases where more strength is required, it may be desired to provide panels 116 with a relatively large number of (or more closely spaced) interior connector components 156. In other cases, where the transverse width dimension 121 of panels 116 is greater, it may be desirable to provide panels 116 with a relatively large number of interior connector components 116. The mere presence of interior connector components 156 does not make it necessary that a standoff 114 be connected to each interior connector component 156. Standoffs 114 may or may not be connected to any particular interior connector component 156 as desired. Where a standoff 114 is not connected to a particular interior connector component 156, the interior connector component 156 may provide an anchor for its panel 116 into the concrete as and when the concrete cures in void 170. In some embodiments, insulation and cladding systems which may not include concrete or other curable construction materials may be designed to provide relatively large (e.g. greater than 24 inches) spaces between adjacent standoffs.

In the illustrated embodiment, the exterior surfaces of panels 116 are generally planar. This is not necessary. In some embodiments, panels 116 may have curved exterior surfaces, corrugated exterior surfaces, surfaces that provide inside corners, and surfaces that provide outside corners. In the case where panels are curved, then the directions in which panels (and their panel connector components) are forced into engagement with standoffs (and their standoff connector components) may be orthogonal (or normal) to a plane that is tangential to the curved panel at the location of the panel connector components. Forcing corner panels into standoffs 114 may comprise first forcing one side of the corner into a first standoff 114 and then subsequently coupling a second side of the corner into a second standoff 114. The first coupling may involve deformation of the corner panel until the second side is forced into its corresponding second standoff.

Surface 14 of existing structure 10 is uneven and includes damaged regions 16A, 16B, 16C, 16D where surface 14 is recessed/indented. Suitable spacers, shims or the like may be used to space standoffs 114 apart from the uneven surface 14 of existing structure 10. Such spacers, shims or the like, may be fabricated from any suitable material including metal alloys, suitable plastics, other polymers, wood composite materials or the like.

It will be understood that directional words (e.g. vertical, horizontal and the like) may be used herein for the purposes of description of the illustrated exemplary applications and embodiments. However, the methods and apparatus described herein are not limited to particular directions or orientations and may be used for repairing existing structures having different orientations. As such, the directional words used herein to describe the methods and apparatus of the invention will be understood by those skilled in the art to have a general meaning which is not strictly limited and which may change depending on the particular application.

The apparatus described herein are not limited to repairing existing concrete structures. By way of non-limiting example, apparatus described herein may be used to repair existing structures comprising concrete, brick, masonry material, wood, metal, steel, other structural materials or the like. One particular and non-limiting example of a metal or steel object that may be repaired in accordance various embodiments described herein is a street lamp post, which may degrade because of exposure to salts and/or other chemicals used to melt ice and snow in cold winter climates.

In some applications, corrosion (e.g. corrosion of rebar) is a factor in the degradation of the existing structure. In such applications, apparatus according to various embodiments of the invention may incorporate corrosion control components. As a non-limiting example, such corrosion control components may comprise anodic units which may comprise zinc and which may be mounted to (or otherwise connected to) existing rebar in the existing structure and/or to new rebar introduced by the repair, reinforcement, restoration and/or protection apparatus of the invention. Other corrosion control systems, such as impressed current cathodic protection (ICCP) systems, electrochemical chloride extraction systems and/or electrochemical re-alkalization systems could also be used in conjunction with the apparatus of this invention. Additionally or alternatively, anti-corrosion additives may be added to concrete or other curable materials used to fabricate repair structures in accordance with particular embodiments of the invention.

As discussed above, the illustrated embodiment described herein is applied to provide a repair structure for an existing structure 10 having a particular shape. In general, however, the shape of the existing structure 10 described herein is meant to be exemplary in nature and methods and apparatus of various embodiments may be used with existing structures having virtually any shape. In particular applications, apparatus according to various embodiments may be used to repair (e.g. to cover) an entirety of an existing structure and/or any subset of the surfaces or portions of the surfaces of an existing structure. Such surfaces or portions of surfaces may include longitudinally extending surfaces or portions thereof, transversely extending surfaces or portions thereof, side surfaces or portions thereof, upper surfaces or portions thereof, lower surfaces or portions thereof and any corners, curves and/or edges in between such surfaces or surface portions.

It may be desired in some applications to change the dimensions of (e.g. to lengthen a dimension of) an existing structure. By way of non-limiting example, it may be desirable to lengthen a pilaster or column or the like in circumstances where the existing structure has sunk into the ground. Particular embodiments of the invention may be used to achieve such dimension changes by extending the apparatus beyond an edge of the existing structure, such that the repair structure, once formed and bonded to the existing structure effectively changes the dimensions of the existing structure.

The male and female "push on" connector components 122, 154, 156 of panels 116 and standoffs 114 represent just one form of push on connection which makes use of restorative deformation forces to make a connection. In some embodiments, other forms of male and female connector components could be provided which may use restorative deformation forces to make connections. In some embodiments, male connector components start with a transversely narrow dimension $w_1$ at their edge(s) closest to the female connector components (e.g. their inward edges), then have a transversely wider dimension $w_2$ in their mid-section and then have a transversely narrower dimension $w_3$ in a section that is distal from the female connector component (e.g. an outward section). One example of a male connector component is a ball shape. In some embodiments, female connector component start with a transversely narrow opening $w_{o1}$ at their edge(s) closest to the male connector components (e.g. at an outward edge), then have a transversely wider opening $w_{o2}$ at a section relatively more distal from their outward edge(s). One example of female connector components is a C-shaped socket. A wide variety of connector component shapes are possible.

The above-described alterations and modifications are described in connection with formwork 110. Many of these alterations and modifications are also applicable to the other formworks and systems described herein.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are consistent with the broadest interpretation of the specification as a whole.

The invention claimed is:

1. A method for covering at least a portion of a surface of an existing structure with a repair structure, the method comprising:

providing a standoff, the standoff elongated in a longitudinal direction and operable from an open configuration to a closed configuration;

while the standoff is in the open configuration, mounting the standoff to the existing structure, such that the standoff projects outwardly away from the surface of the existing structure;

closing the standoff to the closed configuration, the closing of the standoff forming a standoff connector; and coupling a cladding panel to the standoff by engaging the panel with the standoff connector at a location spaced outwardly apart from the surface of the existing structure by a void; wherein:

the standoff comprises first and second arms connected at transversely spaced apart locations to a base, the first and second arms movable relative to the base such that at least a portion of the first arm is transversely spaced apart from at least a portion of the second arm when the standoff is in the open configuration and wherein the at least a portion of the first arm is transversely closer to the at least a portion of the second arm when the standoff is in the closed configuration; and the first and second arms define an outwardly opening standoff opening therebetween when the standoff is in the open configuration.

2. A method according to claim 1 wherein engaging the panel with the standoff connector comprises forcing the panel in an inward direction toward the surface of the existing structure.

3. A method according to claim 1 wherein, in the open configuration, one or more mounting features of the base are accessible from an outward direction via the standoff opening.

4. A method according to claim 1 wherein, in the open configuration, the first and second arms are moveable relative to the base and move relative to one another.

5. A method according to claim 1 wherein, in the closed configuration, the first and second arms are fixed relative to the base and relative to one another.

6. A method according to claim 1 wherein closing the standoff comprises connecting the first arm to the second arm at a location spaced outwardly apart from the base.

7. A method according to claim 6 wherein connecting the first arm to the second arm comprises locking the first arm to the second arm.

8. A method according to claim 6 wherein connecting the first arm to the second arm comprises applying force to one or both of the first and second arms to move one or both of the first and second arms with respect to the base and toward one another.

9. A method according to claim 6 wherein connecting the first arm to the second arm comprises extending one or more first prongs of a first arm connector of the first arm into one or more second hooked concavities of a second arm connector of the second arm.

10. A method according to claim 9 wherein connecting the first arm connector to the second arm connector comprises deforming at least a portion of one of the first arm connector and the second arm connector to create restorative deformation forces which at least partially restore a shape thereof to thereby lock the first arm connector and the second arm connector.

11. A method according to claim 10 wherein:

connecting the first arm connector to the second arm connector comprises deforming at least a portion of one of the first arm connector and the second arm connector to create restorative deformation forces which at least partially restore a shape thereof to thereby lock the first arm connector and the second arm connector; and deformation of the first arm connector comprises deformation of one or more first prongs of the first arm connector and deformation of the second arm connector comprises deformation of one or more of the second prongs of the second arm connector.

12. A method according to claim 1 wherein the first arm is connected to the base by a first joint and the second arm is connected to the base by a second joint wherein the first joint and the second joint each comprise a different material than the base and the first and second arms.

13. A method according to claim 12 wherein the first joint and the second joint are each more flexible than the base and the first and second arms.

14. A method according to claim 1 comprising introducing a curable material to the void between the cladding panel and the existing structure, the panel acting as at least a portion of a formwork for containing the curable material until the curable material cures to provide a repair structure cladded, at least in part, by the panel.

15. Apparatus for repairing at least a portion of a surface of an existing structure, comprising:

a longitudinally extending standoff coupled to the existing structure to project outwardly away from the surface of the existing structure, the standoff operable from an open configuration to a closed configuration; and a cladding panel engageable with a standoff connector of the standoff, after the standoff is converted from the open configuration to the closed configuration, and when so engaged, the panel is spaced outwardly apart from the surface of the existing structure to provide a void between the cladding panel and the surface of the existing structure;

wherein:

the standoff comprises first and second arms connected at transversely spaced apart locations to a base, the first and second arms movable relative to the base such that at least a portion of the first arm is transversely spaced apart from at least a portion of the second arm when the standoff is in the open configuration and wherein the at least a portion of the first arm is transversely closer to the at least a portion of the second arm when the standoff is in the closed configuration;

the first and second arms define an outwardly opening standoff opening therebetween when the standoff is in the open configuration;

one or more mounting features of the base are accessible from an outward direction via the standoff opening when the standoff is in the open configuration; and the first arm comprises a first standoff connector component and the second arm comprises a second standoff connector component and the first and second standoff connector components together form the standoff connector when the standoff is in the closed configuration.

16. An apparatus according to claim 15 wherein the cladding panel is engageable with the standoff connector of the standoff by forcing the cladding panel, in an inward direction toward the surface of the existing structure, into engagement with the standoff connector of the standoff.

17. An apparatus according to claim 15 wherein, in the open configuration, the first and second arms are moveable relative to the base and move relative to one another.

18. An apparatus according to claim 15 wherein in the closed configuration, the first and second arms are fixed relative to the base and relative to one another.

19. Apparatus for repairing at least a portion of a surface of an existing structure, comprising:

a longitudinally extending standoff coupled to the existing structure to project outwardly away from the surface of the existing structure, the standoff operable from an open configuration to a closed configuration; and a first cladding panel and a second cladding panel, each forced in an inward direction toward the surface of the existing structure into engagement with a standoff connector of the standoff when the standoff is in the closed configuration, the first and second engaged panels spaced outwardly apart from the surface of the existing structure to provide a void between the cladding panel and the surface of the existing structure; wherein:

the standoff comprises first and second arms connected at transversely spaced apart locations to a base, the first and second arms movable relative to the base such that at least a portion of the first arm is transversely spaced apart from at least a portion of the second arm when the standoff is in the open configuration and wherein the at least a portion of the first arm is transversely closer to the at least a portion of the second arm when the standoff is in the closed configuration;

the first and second arms define an outwardly opening standoff opening therebetween when the standoff is in the open configuration;

one or more mounting features of the base are accessible from an outward direction via the standoff opening when the standoff is in the open configuration; and the first arm comprises a first standoff connector component and the second arm comprises a second standoff connector component and the first and second standoff connector components together form the standoff connector when the standoff is in the closed configuration.

* * * * *